US010918157B2

(12) United States Patent
Choukeir

(10) Patent No.: US 10,918,157 B2
(45) Date of Patent: Feb. 16, 2021

(54) ADJUSTABLE FASTENING SYSTEM FOR STRAPS

(71) Applicant: Maku Inc., Holyoke, MA (US)

(72) Inventor: William Choukeir, Cornet Chehwan (LB)

(73) Assignee: Maku Inc., Holyoke, MA (US)

( * ) Notice: Subject to any disclaimer, the term of this patent is extended or adjusted under 35 U.S.C. 154(b) by 0 days.

(21) Appl. No.: 16/106,724

(22) Filed: Aug. 21, 2018

(65) Prior Publication Data

US 2019/0053568 A1 Feb. 21, 2019

Related U.S. Application Data

(60) Provisional application No. 62/548,073, filed on Aug. 21, 2017.

(51) Int. Cl.

| | |
|---|---|
| ***A43B 3/12*** | (2006.01) |
| ***A43B 1/14*** | (2006.01) |
| ***A43C 11/12*** | (2006.01) |
| ***A43B 3/10*** | (2006.01) |
| ***A43C 1/06*** | (2006.01) |
| ***A43C 7/08*** | (2006.01) |

(52) U.S. Cl.

CPC ..... *A43B 3/126* (2013.01); *A43B 1/14* (2013.01); *A43B 3/103* (2013.01); *A43B 3/122* (2013.01); *A43C 1/06* (2013.01); *A43C 7/08* (2013.01); *A43C 11/12* (2013.01)

(58) Field of Classification Search

CPC A43B 3/126; A43B 3/122; A43B 1/14; Y10T 24/3713; Y10T 24/1986; Y10T 24/3924; Y10T 24/3918; Y10T 24/3987; Y10T 24/3705

See application file for complete search history.

(56) References Cited

U.S. PATENT DOCUMENTS

| | | | | | |
|---|---|---|---|---|---|
| 1,066,759 | A * | 7/1913 | Schloss | D04C 1/00 | 87/2 |
| 2,602,207 | A * | 7/1952 | Kellems | H02G 1/081 | 403/373 |
| 2,792,609 | A * | 5/1957 | Pittman | A44B 11/20 | 24/164 |
| 3,000,119 | A * | 9/1961 | Altman | A43C 11/00 | 36/58.5 |
| 3,336,683 | A * | 8/1967 | Schellkopf | A43B 3/126 | 36/11.5 |
| 4,364,538 | A * | 12/1982 | Tomlinson | A47G 1/18 | 24/115 H |
| 4,393,876 | A | 7/1983 | Dieterich | | |

(Continued)

FOREIGN PATENT DOCUMENTS

WO 2016195965 A1 12/2016

OTHER PUBLICATIONS

ISRWO of related PCT/US2018/047213 dated Dec. 4, 2018.

*Primary Examiner* — Jila M Mohandesi

(74) *Attorney, Agent, or Firm* — Vorys, Sater, Seymour and Pease LLP

(57) ABSTRACT

A fastening system includes a sleeve having a cylindrical body, and one or more braking members provided on the sleeve. At least one strap is extendable through the sleeve and movable relative to the sleeve while the sleeve is braced. The one or more braking members resist movement of the at least one strap relative to the sleeve.

13 Claims, 12 Drawing Sheets

(56) References Cited

U.S. PATENT DOCUMENTS

| | | | | |
|---|---|---|---|---|
| 4,513,063 | A * | 4/1985 | Hashi | A63B 21/0552 224/318 |
| 4,885,824 | A * | 12/1989 | Schwab | B65D 63/14 24/17 B |
| 5,839,210 | A * | 11/1998 | Bernier | A43B 1/0072 36/50.1 |
| 7,549,201 | B2 * | 6/2009 | Kraft | A43C 1/02 24/713 |
| 7,856,740 | B2 * | 12/2010 | De Bast | A43C 11/146 36/131 |
| 8,291,613 | B2 * | 10/2012 | Cunningham | A43C 15/16 36/11.5 |
| 9,301,580 | B1 * | 4/2016 | Rafaelian | A44C 5/22 |
| 10,123,594 | B2 * | 11/2018 | Rafaelian | A44C 5/22 |
| 10,405,608 | B2 * | 9/2019 | Dyer | A43B 23/0245 |
| 2003/0074806 | A1 * | 4/2003 | Urie | A43B 3/126 36/11.5 |
| 2007/0022629 | A1 | 2/2007 | Bathum | |
| 2008/0110049 | A1 * | 5/2008 | Sokolowski | A43B 3/0031 36/50.1 |
| 2012/0047769 | A1 * | 3/2012 | Hill | A43B 3/105 36/97 |
| 2013/0255045 | A1 * | 10/2013 | Gonzalez | D07B 5/005 24/715.3 |
| 2014/0013553 | A1 | 1/2014 | Soderberg et al. | |
| 2001/4030500 | | 10/2014 | Murieta et al. | |
| 2015/0237950 | A1 * | 8/2015 | Caldwell | A43B 3/24 36/100 |
| 2016/0113350 | A1 * | 4/2016 | Sashen | A43B 3/126 36/11.5 |
| 2017/0265580 | A1 * | 9/2017 | Schneider | A43B 3/001 |

* cited by examiner

ADJUSTABLE FASTENING SYSTEM FOR STRAPS

BACKGROUND

Sandals generally include a sole and a fastening device or system designed to secure the sole to a user's foot. While sandal fastening systems can appear simple, their construction is often quite nuanced to achieve a snug fit against the foot. Some sandal fastening systems, for instance, can include straps, strings, cords, large diameter ropes, multiple attachment points to the sole, loops, knots, and various types of buckles, hitches, and snaps, and all of these component parts and constructs may be made of a variety of different materials. Sandal fastening systems can be further complicated by the fact that similar-length feet can have considerably different widths and girths. Thus, achieving a comfortable fit for a wide range of foot shapes ideally requires a sandal fastening system having straps that are adjustable along one or more of the forefoot, the ankle, and the heel.

Available solutions for adjusting strap lengths in conventional sandal fastening systems have their limitations. Some require a long loose tail to be available, while others are bulky, and still others convey a very distinct aesthetic that may not be in line with the intended design. Moreover, some sandal fastening systems are limited in their adjustable length or are simply not user-friendly and otherwise inconvenient to adjust.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

SUMMARY OF THE DISCLOSURE

Figure 1:
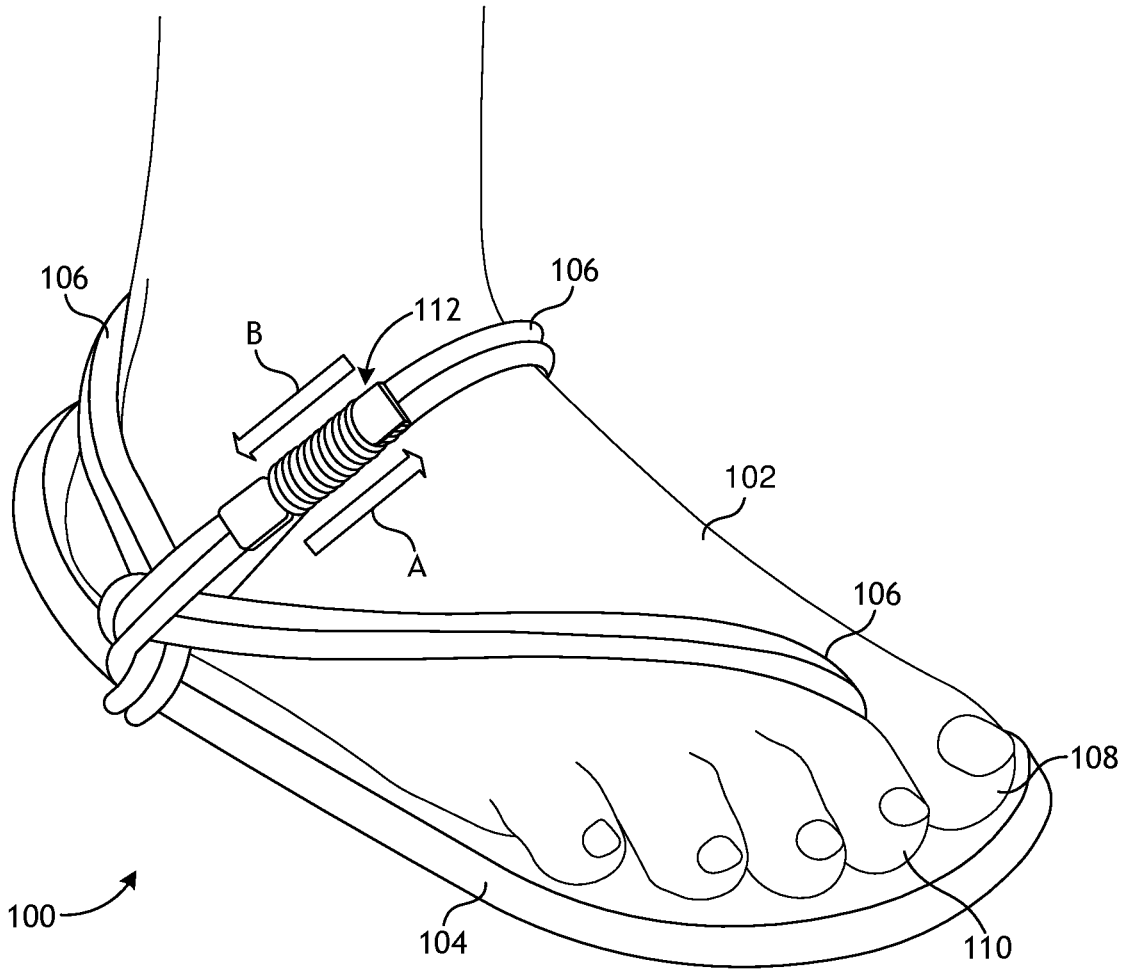
FIG. 1 is an isometric view of an example sandal, according to one or more embodiments of the present disclosure.

Disclosed are fastening systems for adjusting straps easily, comfortably, and quickly. While the embodiments discussed herein are generally directed to fastening systems used in conjunction with footwear (i.e., sandals), the presently disclosed fastening systems may alternatively be applied in other contexts or industries where multiple straps or cords require slidable adjustment. For instance, the presently disclosed embodiments may alternatively be applied on bags, belts, necklaces, bracelets, jewelry and accessories that requires a strap or cord, neck straps and other straps used to carry accessories (binoculars, cameras, whistles, water bottles, etc.), sports equipment and exercise equipment that require adjustable straps, rope, or cords, backpacks, bags, waist/belt bags (i.e., fanny packs), suspenders for trousers, adjustable pant waist diameter (similar to draw strings), head bands, alternative to shoe laces, and other applications where the length of straps or cords are desired to be adjustable for use.

In some embodiments, a fastening system may include a sleeve that has a cylindrical body, and one or more braking members may be provided on the sleeve. At least one strap may be extendable through the sleeve and may be movable relative to the sleeve while the sleeve is braced. Moreover, the one or more braking members may be configured to resist movement of the at least one strap relative to the sleeve.

In some embodiments, the sleeve may comprise a base having a first end and a second end opposite the first end, and a sheath extending about the base and providing the braking members. In such embodiments, at least two straps may be extendable through the sheath and one of the at least two straps may be fixed to the base. A first tab may be provided at the first end and define a first channel, a second tab may be provided at the second end and may define a second channel, and a center strip may extend between the first and second tabs. The sheath may comprise a cord wrapped multiple times around the center strip and extending through the first and second channels, and the loops of the cord may comprise the one or more braking members.

In some embodiments, the braking members may be formed in the sleeve with one or more cuts. In such embodiments, the at least one strap may include a first strap secured to the sleeve, and a second strap movable relative to the first strap and the sleeve to adjust a tension in the fastening system. Alternatively, in such embodiments, the at least one strap may comprise a single strap and the sleeve may include an extension that extends axially away from the sleeve and secures the sleeve relative to the single strap.

In some embodiments, a sandal to be worn on a foot includes a sole, at least one strap coupled to the sole and extendable around one or more of a forefoot, an ankle, and a heel of the foot, and a fastening system operatively coupled to the at least one strap. The fastening system may include a sleeve having a cylindrical body, and one or more braking members provided on the sleeve. The at least one strap may extend through the sleeve and may be movable relative to the sleeve while the sleeve is braced to adjust a tension in the strap against the foot. Moreover, the one or more braking members may resist movement of the strap relative to the sleeve. The sole may have a front and a back and may provide a toe guard at the front that is angled upward relative to horizontal. The sole may also provide a heel guard at the back that is angled upward relative to horizontal. In some embodiments, the sole may provide or otherwise include a strap aperture defined in a top surface of the sole and sized to receive the at least one strap, a groove may be defined in a bottom surface of the sole to receive the at least one strap from the strap aperture. In such embodiments, the groove may define a slot that redirects the strap back toward the top surface of the sole. The slot may have a depth sufficient to prevent the strap from contacting the underlying surface.

DETAILED DESCRIPTION

The present disclosure relates to sandal footwear and, more particularly, to fastening systems incorporated into sandal designs for simple and quick adjustment of strap lengths to correspondingly adjust tension against the foot.

FIG. 1 is an isometric view of an example sandal 100 designed to be worn on a user's foot 102, according to one or more embodiments of the present disclosure. As illustrated, the sandal 100 may include a sole 104 and one or more straps 106 configured to attach the sole 104 to the foot 102. The strap(s) 106 may loop or otherwise extend around one or more of the forefoot, the ankle, and the heel of the foot 102 to secure the sandal 100 to the foot 102. As used herein, the term "strap" refers to any flexible and elongated material capable of wrapping (looping) around the foot 102 to secure the sole 104 to the foot 102. The strap(s) 106 may comprise, but are not limited to, ropes, cords, strings, lines, leads, wires, folded and/or stitched fabric (e.g., woven and non-woven materials), leather, bands, injection molded or compression molded bands, or any combination thereof.

In the illustrated embodiment, the strap(s) 106 are depicted as lengths of rope, and preferably comprise a relatively soft rope or material since the strap(s) 106 come into direct contact with the skin of the foot 102 during use. Moreover, the strap(s) 106 are depicted as extending around the foot 102 in pairs (e.g., two-by-two), but could alternatively extend as single lines or more than two lines, without departing from the scope of the disclosure. At the front of the foot 102, the strap(s) 106 may extend between the hallux toe 108 (i.e., the "great toe") and the second toe 110 (i.e., the "long toe"), and may be designed to respect the natural spacing between the two toes 108, 110 while being compressed therebetween. In other embodiments, the strap(s) 106 may be designed to extend between other toes or extend between more than two toes (e.g., at two or more locations), without departing from the scope of the disclosure. In yet other embodiments, the strap(s) 106 could also span across the forefoot width-wise (laterally) without passing between any toes.

The sandal 100 may further include a fastening system 112 operatively coupled to the straps 106 and movable (slidable) to adjust the tension in the straps 106 against the foot 102. The fastening system 112 may form a generally cylindrical tube or channel (alternately referred to herein as a "sleeve") that surrounds the straps 106, and at least one of the straps 106 may be free to slide within the cylindrical tube or channel while the cylindrical tube or channel is braced (e.g., with one's fingers). Pulling at least one of the straps 106 in either direction relative to the cylindrical tube or channel may adjust the tension in the fastening system 112.

In the illustrated embodiment, the fastening system 112 is generally positioned against the ankle of the foot 102, but may alternatively be positioned at other locations on the foot 102, such as on the heel or the forefoot, or a combination thereof, without departing from the scope of the disclosure. The fastening system 112 may be movable (slidable) in a first direction A to tighten the straps 106 against the foot 102, and movable (slidable) in a second direction B opposite the first direction A to loosen the straps 106. As will be appreciated, however, the design of the fastening system 112 may be altered such that the directions A, B are reversed to tighten and loosen the straps 106.

As will be discussed herein, the fastening system 112 may be designed to allow a user to easily, comfortably, and quickly adjust the tension in the straps 106. As discussed in more detail below, the straps 106 may penetrate the sole 104 on opposite sides of the foot 102 via corresponding side strap apertures (not visible in FIG. 1). By appropriately feeding (e.g., advancing or retracting) the straps 106 through the side strap apertures, each length of the straps 106 that wraps around the forefoot, the ankle, and the heel may be individually adjustable. The tension of the straps 106 on the forefoot, for example, would be adjusted by pulling the straps 106 through the side strap apertures on one side of the foot 102. The tension of the straps 106 around the heel would then be adjusted by pulling the straps 106 through the side strap apertures on the opposite side of the foot 102. Lastly, the tension of the straps 106 around the ankle would be adjusted by removing the slack in the straps 106 through operation of the fastening system 112. As will be appreciated, this allows the fastening system 112 to adjust strap 106 tension across all points of contact between the straps 106 and the foot, thus enabling the sandal 104 to adapt to a wide range of foot shapes, lengths, girths, and widths.

Figure 2:
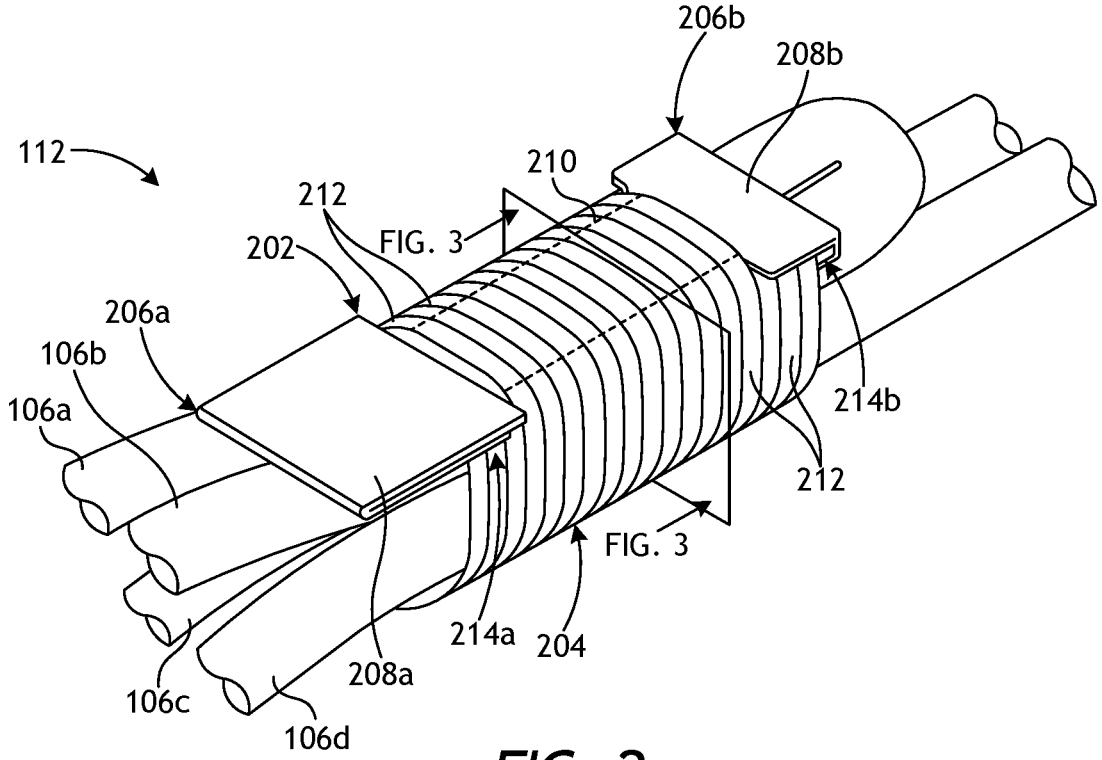
FIG. 2 is an enlarged isometric view of the fastening system of FIG. 1, according to one or more embodiments.

FIG. 2 is an enlarged isometric view of one embodiment of the fastening system 112. In the illustrated embodiment, the fastening system 112 is used in conjunction with four straps, shown as a first strap 106*a*, a second strap 106*b*, a third strap 106*c*, and a fourth strap 106*d*. The fastening system 112 may be secured (fixed) to the first and second straps 106*a,b* and pulling the third and fourth straps 106*c,d* in either direction while bracing the fastening system 112 (e.g., with one's fingers) may adjust the tension in the straps 106*a-d* against the foot 102 (FIG. 1).

As illustrated, the fastening system 112 includes a base 202 and a sheath 204 extending about (e.g., surrounding, encircling, etc.) a portion of the base 202 and the straps 106*a-d*. The combination of the base 202 and the sheath 204 may form the generally cylindrical tube or channel mentioned above, and thus the base 202 and the sheath 204 may be jointly referred to herein as a "sleeve." The base 202 may comprise a generally elongate structure having a first end 206*a* and a second end 206*b* opposite the first end 206*b*. The base 202 may provide or otherwise define a first tab 208*a* at the first end 206*a*, a second tab 208*b* at the second end 206*b*, and a center strip 210 (shown in dashed lines) that extends between the first and second tabs 208*a,b*. In some embodiments, the first and second tabs 208*a,b* may be characterized as "elevated" sections of the base 202, and the center strip 210 may be characterized as a "recessed" middle section of the base 202. The base 202 may be made of a variety of rigid or semi-rigid materials including, but not limited to, a polymer (e.g., polyester, polypropylene, nylon, thermoplastic polyurethane, acrylonitrile butadiene styrene, thermoplastic rubber, polylactic acid, polyvinyl acetate, polyethylene terephthalate, polyethylene terephthalate copolyester, high impact polystyrene, etc.), a natural material (e.g., leather, rubber, latex, wood, etc.), a metal (e.g., copper, bronze, aluminum, an alloy, etc.), a woven or braided material, a non-woven material (e.g., non-woven wool, a microfiber fabric, etc.), a composite (e.g., carbon fiber, fiberglass, etc.), or any combination thereof.

The sheath 204 may comprise a cord 212 looped (wrapped) multiple times around the base 202 and the straps 106*a-d* to secure the fastening system 112 to the straps 106*a-d*. The cord 212 may comprise an elongated thread, string, line, etc. of material that exhibits a diameter less than the diameter of the straps 106*a-d*. In some embodiments, the cord 212 may comprise a continuous, unbroken length of material. Alternatively, the cord 212 may be formed of multiple lengths of a material attached end to end, without departing from the scope of the disclosure. The cord 212 may be made of a variety of materials including, but not limited to, polyester, cotton, nylon, hemp, aramid, polyethylene, sisal, manila, polypropylene, latex, polyamide, silk, or any combination thereof. In other embodiments, or in addition thereto, the cord 212 may be made of a single core of polymer (e.g., thermoplastic polyurethane, thermoplastic rubber, or other flexible materials).

In the illustrated embodiment, the cord 212 is progressively wrapped multiple times around the center strip 210 and the straps 106*a-d*. Upon reaching the tabs 208*a,b* on either extremity of the center strip 210, the cord 212 may transition from the center strip 210 to extend through a first channel 214*a* (hidden in FIG. 2) defined by the first tab 208*a* and a second channel 214*b* defined by the second tab 208*b*. In at least one embodiment, the loops of the cord 212 extending through the channels 214*a,b* may be arranged in the same plane as the loops of the cord 212 traversing the center strip 210. As described in more detail below, while the base 202 and the sheath 204 may be jointly referred to herein as a "sleeve," the several revolutions or "loops" of the cord 212 about the base 202 and the straps 106*a-d* may operate as parallel "braking members" that resist movement of at least one of the straps 106*a-d* in either direction relative to the base 202.

The first and second tabs 208*a,b* may be designed to prevent the fastening system 112 from becoming undone (failing). For example, the first and second tabs 208*a,b* may be wider than the center strip 210, which may prevent the cord 212 from shifting on top of the tabs 208*a,b* and otherwise climbing over the loops of the cord 212 passing through the channels 214*a,b*. Moreover, in some embodiments, the first and second tabs 208*a,b* may be thicker than the center strip 210 and otherwise form a step-up (raised) transition from the center strip 210, which also prevents the cord 212 from shifting on top of the tabs 208*a,b*. Lastly, routing the cord 212 through the channels 214*a,b* on either end of the base 202 also prevents the total length of the fastening system 112 from expanding lengthwise, which could lead to system failure. Knots (not visible) in the cord 212 may also have the same purpose since the material of the base 202 may exhibit a small percentage of stretch. However, it is noted that the small percentage of stretch in the material does not adversely affect performance.

Figure 3:
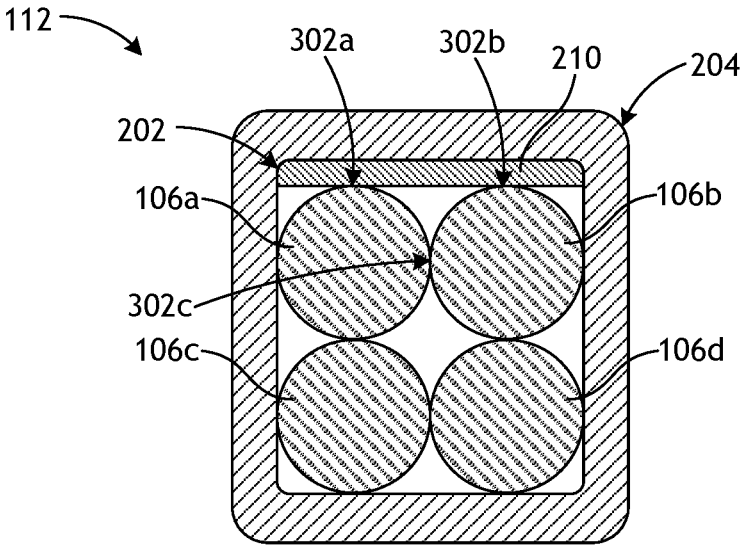
FIG. 3 is a cross sectional end view of the fastening system of FIGS. 1 and 2 as taken along the plane indicated in FIG. 2.

FIG. 3 is a cross sectional end view of the fastening system 112 taken along the plane indicated in FIG. 2. As illustrated, the combination of the base 202 and the sheath 204 encircle the straps 106*a-d* in a sleeve-like fashion. In the illustrated embodiment, the first and second straps 106*a,b* are positioned directly below the center strip 210 and arranged laterally side-by-side, and the third and fourth straps 106*c,d* are positioned directly below the first and second straps 106*a,b* and also arranged laterally side-by-side. In some embodiments, the first and second straps 106*a,b* may be secured (fixed) to the center strip 210, each other, and the sheath 204 such that the fastening system 112 and the first and second straps 106*a,b* may be movable relative to the third and fourth straps 106*c,d* (or vice versa) to adjust strap tension. More specifically, the first and second straps 106*a,b* may be secured (fixed) to the underside of the center strip 210 at fastening points 302*a* and 302*b*, and to each other at fastening point 302*c*. In other embodiments, however, the fastening system 112 may work equally well with the first and second straps 106*a,b* not fixed to fastening points 302*a* and 302*b*. In at least one embodiment, the first and second straps 106*a,b* may be secured (fixed) to each other at fastening point 302*c* by virtue of knots (not shown) made in the cord 212 (FIG. 2), as will be described in more detail below. Moreover, as also described below, the cord 212 may be being threaded through the first and second straps 106*a,b*, which effectively secures the first and second straps 106*a,b* to the base 202 and the sheath 204.

In some embodiments, an adhesive or the like may be used at each fastening point 302*a-c*. In at least one embodiment, the adhesive may be applied at the fastening points 302*a-c* along the entire length of the center strip 210, along the length of the base 202, or along a length corresponding to the length of the center strip 210 or the base 202. Depending on the materials used for the straps 106*a-d*, the sheath 204, and the center strip 210, ultrasonic welding may alternatively be used at each fastening point 302*a-c*. In such embodiments, the fastening points 302*a-c* may be ultrasonically welded along all or a portion of the length of the center strip 210, along the length of the base 202, or along a length corresponding to the length of the center strip 210 or the base 202.

As illustrated, the sheath 204 encircles the straps 106*a-d* and the center strip 210. In at least one embodiment, as depicted, the sheath 204 may be wound about the straps 106*a-d* such that the straps 106*a-d* become slightly compressed from their natural (normal) cross-sectional shape. In such embodiments, the sheath 204 may be constructed and/or dimensioned to compress the straps 106*a,b* slightly such that they fit snugly within the sheath 204. Compressing or squeezing the straps 106*a-d*, however, may not be overly severe to prevent the unsecured third and fourth straps 106*c,d* from moving relative to the first and second straps 106*a,b*. Rather, the third and fourth straps 106*c,d* may be able to move lengthwise in either direction relative to the first and second straps 106*a,b* (or vice versa).

It should be recognized that some types of straps (e.g., ropes) are made with a relatively open central or core area and others contain a core or are otherwise evenly filled throughout. Straps or ropes that are filled may require no additional treatment for securing to the center strip 210 and to each other, but ones having no core tend to compress more easily. In such a scenario, a wire or similar stiff probe may be inserted into the center of the straps or ropes to provide a temporary stiffness and help retain the straps or ropes in position while the sheath 204 is being formed, following which the wire or probe may then be removed.

As further explanation, when straps or ropes with a central core are used, the tension created by the sheath 204 may be maintained because the ropes allow minimal self-compression. Thus, the set tension is maintained and allows the third and fourth straps 106*c,d* from sliding only when the sheath 204 is braced. When the sheath 204 is not braced, pulling of the third and fourth straps 106*c,d* creates additional tension in the sheath 204 and prevent these straps 106*c,d*, from sliding. In contrast, when straps or ropes without a central core are used, then during the application of the sheath 204 (i.e., the wrapping of the cord 212) it becomes very difficult to maintain a consistent tension around the straps 106*a-d*.

Once the wrapping is complete, the ability of core-less straps 106*a-d* to self-compress creates a much wider range of resulting tension in the sheath 204 (as compared to straps with a central core). This hard-to-control wide range of tension can create, at one extreme, too much tension that prevents the third and fourth straps 106*c,d* from sliding even when the sheath 204 is braced, or on the other extreme, not enough tension allowing the third and fourth straps 106*c,d* from sliding even when the sheath 204 is not braced. Hence, to render the coreless-rope as functional as the core-rope, a temporary probe may be inserted into the first and second straps 106*a,b* (which replicates a core), then an adhesive is applied on the whole surface of the rope (under the center strip 210). This adhesive becomes hard when set, the probe is then removed, and the coreless-rope is transformed into a rope that cannot self-compress, thus allowing similar functionality to a rope with a core.

In some embodiments, each strap 106*a-d* may exhibit a circumference ranging from about 3 mm to about 200 mm (to accommodate larger items of sport equipment, for example, or simply for aesthetics). The center strip 210 may have a length ranging from about 1 cm to about 25 cm depending on the amount of pulling tension the fastening system 112 needs to accept before sliding without bracing starts to happen. In some cases, the more the pulling forces, the longer the length of the center strip 210 may be. As will be appreciated, the foregoing ranges for the circumference of straps 106*a-d* and the ranges for the length of the center strip 210 are provided merely for illustrative purposes and, therefore, should not be considered limiting to the present disclosure. In at least one embodiment, the diameter of the straps 106*a-d* may be about half the width of the center strip 210, or slightly more than half, which facilitates the snug fit for the construction shown in FIG. 3. Moreover, while the straps 106*a-d* exhibit a generally circular cross-section, other cross-sectional shapes may be employed including, but not limited to, oval, ovoid, polygonal (e.g., triangular, rectangular, pentagonal, etc.), without departing from the scope of the disclosure.

It will be appreciated that the fastening system 112 is not required to work with two pairs of straps (e.g., straps 106*a,b* and 106*c,d*). Rather, any number of straps may be used in any combination in the fastening system 112, so long as at least one is fixed to the sheath 204 and at least one is free to slide within the sheath 204, and as long as the sliding strap is directly in contact with the sheath 204 in at least ¼ of the circumference of its cross section (otherwise there may not be enough friction and tension to prevent unintended sliding). Accordingly, the fastening system 112 may be employed with one pair of straps, two pairs of straps, one upper strap in combination with two bottom straps, two upper straps in combination with one bottom strap, or five or more straps used in any combination, without departing from the scope of the disclosure.

Figure 4:
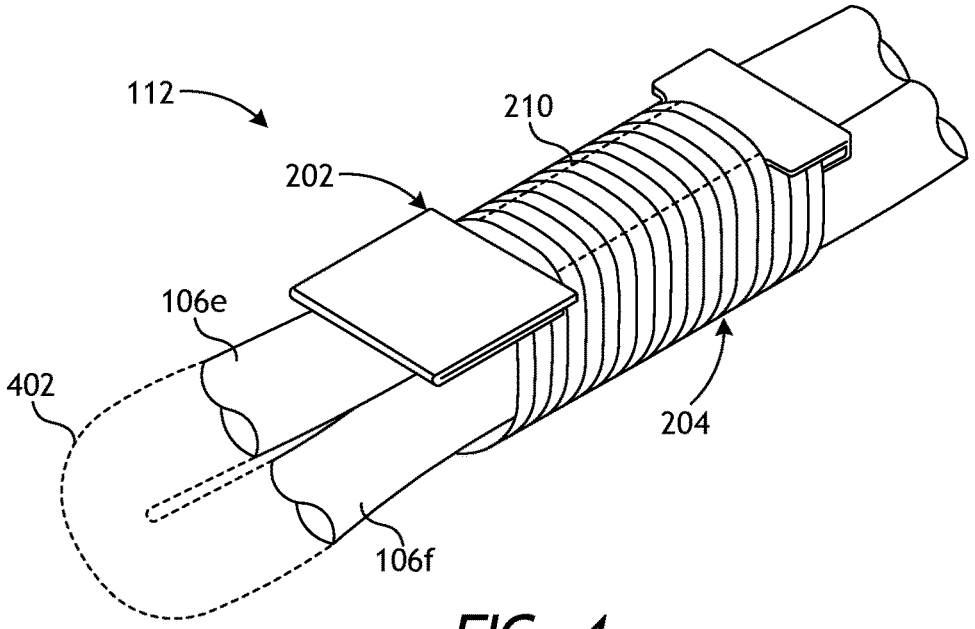
FIG. 4 is an enlarged isometric view of an alternative embodiment of the fastening system of FIGS. 1 and 2, according to one or more additional embodiments.

FIG. 4 is an enlarged isometric view of an alternative embodiment of the fastening system 112, according to one or more additional embodiments. In contrast to the fastening system 112 depicted in FIGS. 2 and 3, the fastening system 112 of FIG. 4 is secured to and otherwise positioned about two straps, shown as a fifth strap 106*e* and a sixth strap 106*f*, which may be similar to the straps 106*a-d* of FIGS. 2 and 3. In at least one embodiment, for example, the fifth and sixth straps 106*e,f* may be the same as the first and third straps 106*a,c*. In the illustrated embodiment, the combination of the base 202 and the sheath 204 may be referred to as a "sleeve" that encircles the straps 106*e,f*.

In the illustrated embodiment, the fastening system 112 may be secured (fixed) to the fifth strap 106*e* and pulling the sixth strap 106*f* in either direction relative to the fastening system 112 and while bracing the fastening system 112 (e.g., with one's fingers) may adjust the tension in the straps 106*e,f* against the foot 102 (FIG. 1). More specifically, the fifth strap 106*e* may be secured (fixed) to the base 202 (i.e., the underside of the center strip 210) and the sheath 204 such that the sixth strap 106*f* may be movable relative to the fastening system 112 and the fifth strap 106*e* while bracing the fastening system 112 (e.g., with one's fingers) to adjust strap tension. Similar to other embodiments, the fifth strap 106*e* may be secured (fixed) to the base 202 and the sheath 204 using an adhesive, ultrasonic welding, or the like. In the illustrated embodiment, the straps 106*e,f* may exhibit a diameter that is about the width of the center strip 210, or slightly more than the width, which facilitates a snug fit with the sheath 204.

In some embodiments, the fifth and sixth straps 106*e,f* may be interconnected on one side of the fastening system 112, such as by forming an interconnecting loop 402 (shown in dashed lines). In other embodiments, however, the fifth and sixth straps 106*e,f* may comprise discrete lengths of material. As will be appreciated, this may allow for more versatility in real-world applications. In such embodiments, a stopper or slide stop (not shown) may be installed on the straps 106*e,f* to prevent the straps 106*e,f* from completely passing through the sheath 204. Alternatively, the discrete lengths of materials may be connected to individual elements or other parts of a real-world application embodiment, where the elements or parts are too large to pass through the sheath 204.

Figure 5A:
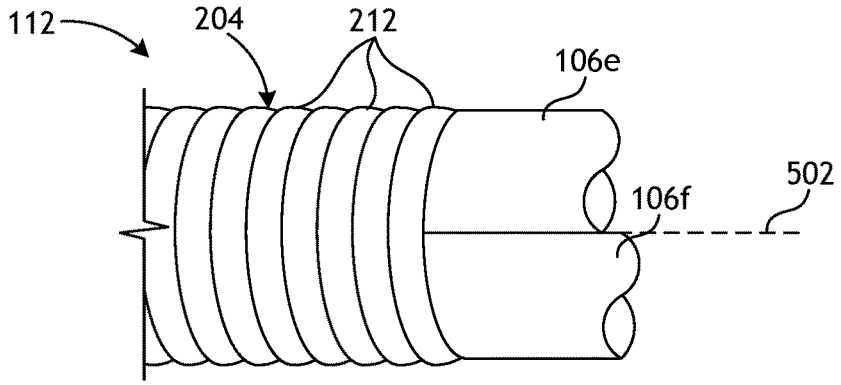
FIGS. 5A and 5B are progressive side views depicting example operation of a portion of the fastening system of FIG. 4.
Figure 5B:
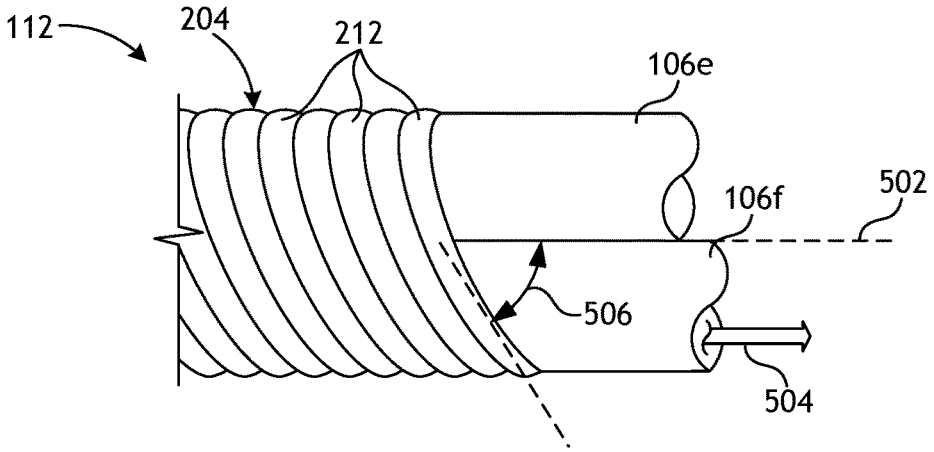

FIGS. 5A and 5B are progressive side views depicting example operation of a portion of the fastening system 112 of FIG. 4, according to one or more embodiments. While FIGS. 5A-5B depict operation of the fastening system 112 with one pair of straps 106*e,f*, the following operational description may equally apply to other applications, such as the fastening system 112 of FIGS. 2-3, which includes four straps 106*a-d*. For simplicity, the base 202 (FIG. 4) is not depicted in FIGS. 5A-5B, which only depict interaction between the straps 106*e,f* and the sheath 204. As discussed above, the fifth strap 106*e* may be secured (fixed) to the sheath 204, and the sixth strap 106*f* may be movable relative to the fifth strap 106*a* (or vice versa) to adjust strap tension.

In FIG. 5A, no tension is applied on the sixth strap 106*f* and, consequently, the cord 212 may reside substantially perpendicular to a longitudinal axis 502 of the fastening system 112. When tension is applied on either strap 106*e,f*, however, the cord 212 will move from perpendicular in the direction of the tensile load, but only where the cord 212 makes contact with the particular strap being pulled. Such movement of the cord 212 places the cord 212 at an angle relative to the strap being pulled, which increases the tension in the cord 212 and thereby enhances the friction between the cord 212 and the strap being pulled.

In FIG. 5B, the fastening system 112 is shown subjected to a tensile load 504 applied to the sixth strap 106*f*. As the sixth strap 106*f* is pulled, the loops of the cord 212 are correspondingly pulled in the same direction and toward an angle 506 offset from the longitudinal axis 502. Urging the loops of the cord 212 to the angle 506 generates additional tension in the cord 212 and correspondingly enhances the friction against the sixth strap 106*f* that serves as a braking effect (mechanism) that resists further movement. Each loop of the cord 212 may function independently and act as a braking member in the fastening system 112 and for axially adjacent loops. Accordingly, the multiple and individual loops of the cord 212 may operate as and be referred to herein as "braking members" that resist movement of the sixth strap 106*f* in the direction of the tensile load 504.

When the loops of the cord 212 (i.e., the "braking members) are braced (i.e., with one's fingers) against the direction of the tension, however, the loops may be forced to remain perpendicular to the longitudinal axis 502 of the fastening system 112. This allows the strap 106*f* being pulled to move in the direction of the tension without increasing the tension in the cord 212. Consequently, bracing the sleeve (e.g., the combination base 202 and sheath 204) circumvents the braking effect of the loops of the cord 212.

Thus, increasing the number of loops in the cord 212 may correspondingly increase the resistance of the fastening system 112. As will be appreciated, the ability to control the resistance in the fastening system 112 by increasing the number of loops allows for a wider range of real-world applications, where some might require little resistance to pulling forces, while others may require resistance to large pulling forces.

Figure 6A:
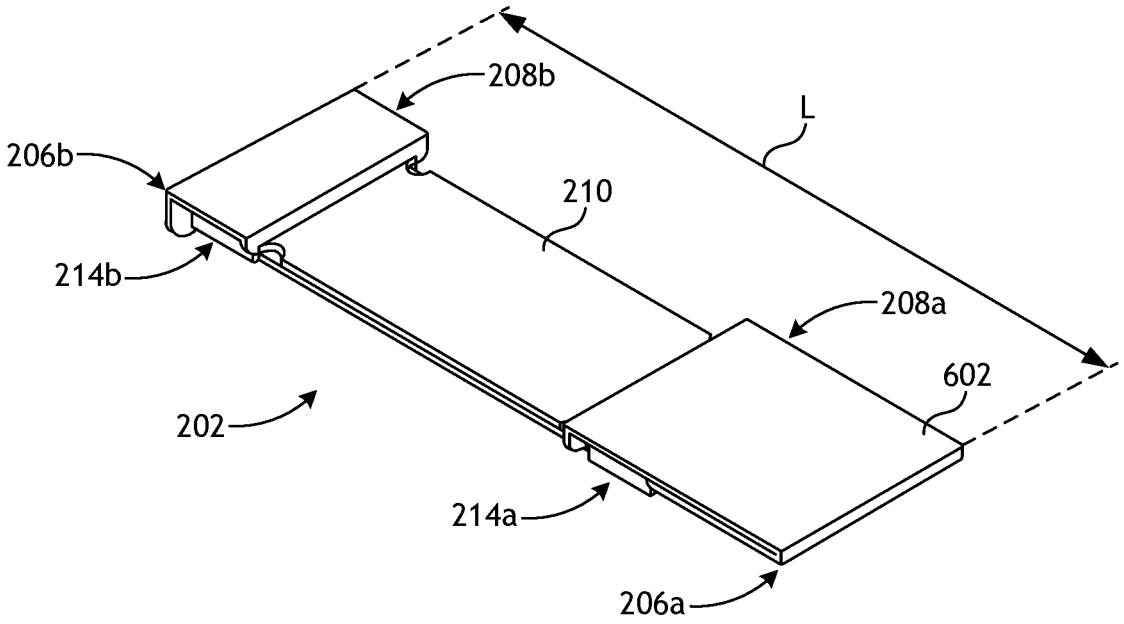
FIGS. 6A and 6B are isometric views of the base of FIGS. 2 and 4.
Figure 6B:
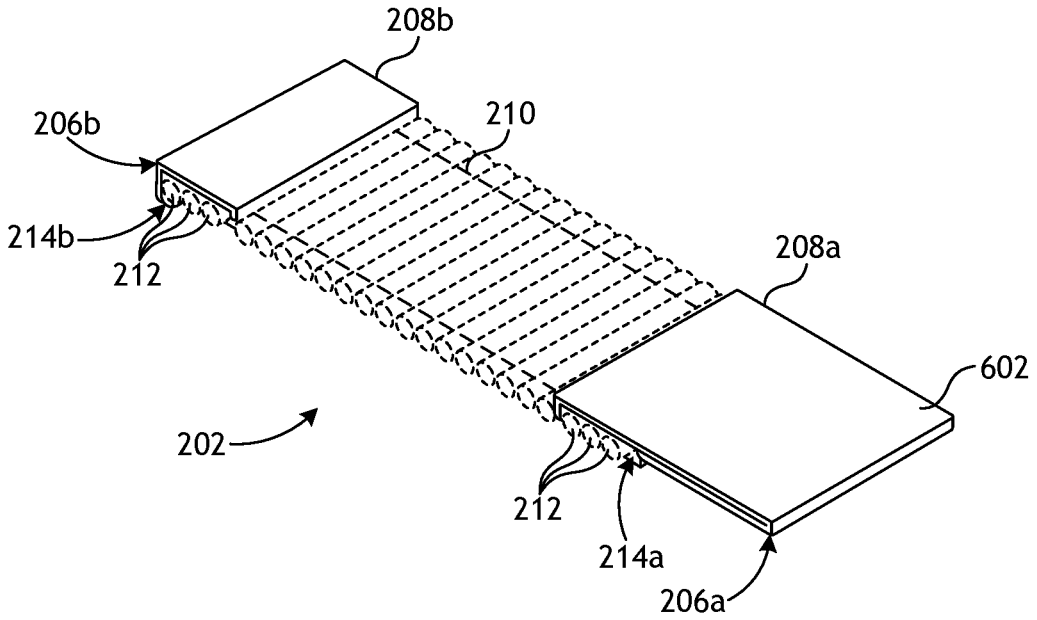

FIGS. 6A and 6B are isometric views of the base 202 of FIGS. 2 and 4, according to one or more embodiments. More specifically, FIG. 6A depicts the base 202 independent of any other structure, and FIG. 6B depicts the base 202 with a cutaway portion of the sheath 204 mounted thereto. The length L (FIG. 6A) of the base 202 between the first and second ends 206*a,b* will generally depend on its application. For applications related to footwear (e.g., sandals), for example, the length L may range between about 1 cm and about 5 cm. For applications other than footwear, however, such as bags, belts, etc., the length L may range between about 1 cm and about 25 cm, and may depend on the resistance required for the particular application. The ranges for the length L mentioned herein are provided merely for illustrative purposes and, therefore, should not be considered limiting to the present disclosure.

As illustrated, the base 202 includes the first and second tabs 208*a,b* and the center strip 210 extending therebetween. The tabs 208*a,b* may be elevated or raised as compared to the center strip 210, and may exhibit a width greater than the width of the center strip 210. Moreover, the first and second tabs 208*a,b* define the first and second channels 214*a,b*, respectively. As best seen in FIG. 6B, one or more loops of the cord 212 may extend through each channel 214*a,b*, and the loops of the cord 212 traversing the center strip 210 may be arranged in the same plane as the loops of the cord 212 extending through the channels 214*a,b*. In the illustrated embodiment, the loops extending through the channels 214*a,b* may help secure the sheath 204 to the base 202. In at least one embodiment, for example, the loops extending through the channels 214*a,b* may be fixed to the base 202 using, for example, ultrasonic welding, and adhesive, stitching, or any combination thereof.

In at least one embodiment, the first tab 208*a* may be longer than the second tab 208*b* or may otherwise provide or define an extension 602. In some embodiments, the extension 502 may provide a location where a brand name or product identification may be placed, such as through embossing, heat stamping, weaving, branding, etc.

FIGS. 7A-7E depict step-by-step assembly (construction) of one embodiment of the base 202 of FIGS. 2, 4, and 6A-6B. As illustrated, the base 202 may comprise a strip of base material cut into a particular shape to form a body 702 configured to be bent, folded, or otherwise manipulated into the final shape of the base 202. The body 702 may be made of a variety of rigid or semi-rigid materials including, but not limited to, a polymer (e.g., polyester, polypropylene, nylon, thermoplastic polyurethane, acrylonitrile butadiene styrene, thermoplastic rubber, polylactic acid, polyvinyl acetate, polyethylene terephthalate, polyethylene terephthalate copolyester, high impact polystyrene, etc.), a natural material (e.g., leather, rubber, latex, wood, etc.), a metal (e.g., copper, bronze, aluminum, an alloy, etc.), a woven or braided material, a non-woven material (e.g., non-woven wool, a microfiber fabric, etc.), a composite (e.g., carbon fiber, fiberglass, etc.), or any combination thereof.

Figure 7A:
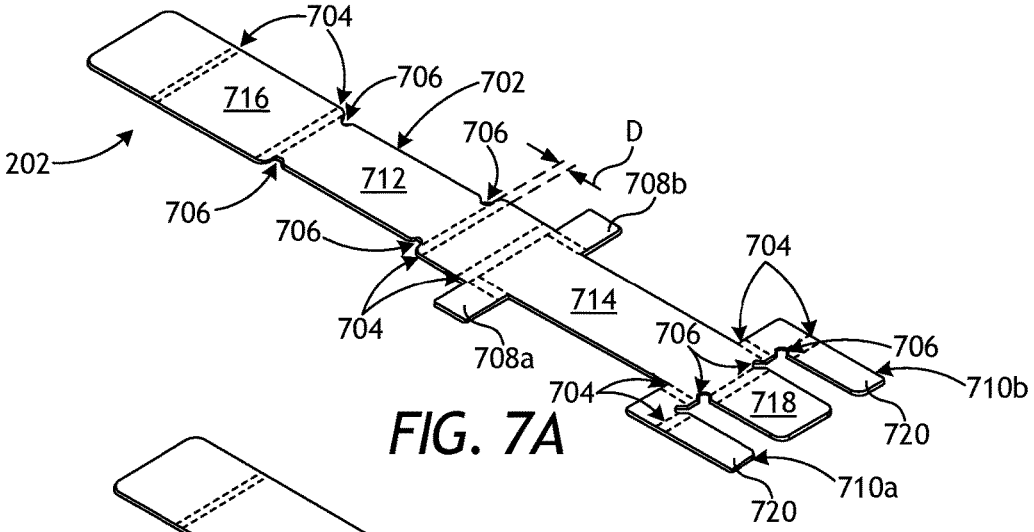
FIGS. 7A-7E depict step-by-step assembly of one embodiment of the base of FIGS. 2, 4, and 6A-6B.

Referring first to FIG. 7A, the body 702 may include a plurality of score lines 704 defined in the base material and indicating areas or positions where the body 702 is to be folded. In some embodiments, the score lines 704 may comprise holes defined through the base material using cutting or scoring metal die cut plates. In such embodiments, the score lines 704 may weaken the base material at those locations to help facilitate folding. In other embodiments, however, the score lines 704 may comprise superficial indentations, depressions, or markings. The score lines 704 may also indicate the direction of the fold (e.g., downwards or upwards). More particularly, most scoring dies have female and male parts, and the direction of the resulting 'U' shaped indentation or perforation indicates the direction in which the material is primed (prone) to be bent.

In some embodiments, the score lines 704 may be provided in pairs, and the distance D between adjacent score lines 704 may be directly proportional to the width of the cords 212 (FIGS. 2, 5A-5B, and 6B) and/or the thickness of the base material. The distance D may be fine-tuned to the nearest tenth of a millimeter, and when incorporating a new base material or a different sized cord 212, the distance D may be re-adjusted to accommodate the thickness change.

In some embodiments, one or more notches 706 may be defined in the body 702 along one or more edges and/or at pre-selected corners of the base material. The notches 706 may be provided at locations of potential tensile loading during use to help mitigate tearing (ripping) of the base material. Most flexible materials are easier to tear at locations where a small tear has already started, or where a sharp corner exists. Cutting the base material of the body 702 with die cutting knives will inherently result in sharp edges and angles, and thus constitute weak points that may be prone to tearing. Replacing these weak points with the arcuate notches 706 eliminates the sharp edges or microscopic tears caused by the cutting die, and helps spread tensile loading across an arcuate surface. As a result, ripping or tearing of the base material may be substantially mitigated.

The body 702 may further include or define one or more substantially rectangular flaps 708*a* and 708*b*, and one or more L-shaped flaps 710*a* and 710*b*. A panel 712 may extend distally from the flaps 708*a,b* and may exhibit dimensions similar to the dimensions of the center strip 210 (FIG. 6A). The flaps 708*a,b* and 710*a,b* may be offset longitudinally from each other on the body 702 to help define a central support 714 that will be longer than the panel 712. A scored extension 716 may extend distally from the panel 712, and a slightly narrower extension 718 may interpose the L-shaped flaps 710*a,b*. Each flap 710*a,b* may include or otherwise provide a stem portion 720 that is laterally offset a short distance from the extension 718.

Figure 7B:
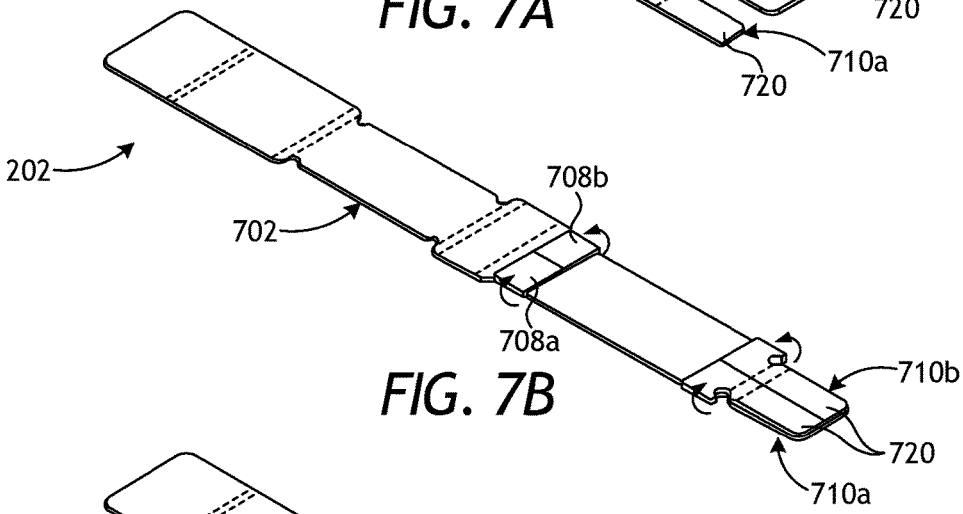

In FIG. 7B, the flaps 708*a,b* and L-shaped flaps 710*a,b* (and corresponding stem portions 720) have each been folded inward and onto the top surface of the central support 714. The L-shaped flaps 710*a,b* are folded such that the stem portions 720 substantially cover the extension 718 (FIG. 7A). The flaps 708*a,b* and 710*a,b* serve the purpose to raise the altitude of the floor of the resulting channels 214*a,b* (FIG. 7D) to the same altitude of the floor of the center strip (e.g., the panel 712). Otherwise, the channels 214*a,b* and enveloping tabs might be of a total lower height than that of the sheath 204 (FIGS. 2 and 4) in the area of the center strip 210 (FIG. 6A). This increases the chance of the portions of the sheath 204 that traverses the center strip 210 from passing over the first loop or more that are passing through the channels 214*a,b* on both extremities. The flaps 710*a,b* may also reinforce the resulting connection between the scored extension 716, the narrower extension 718, the panel 712, and the central support 714. More particularly, if the scored extension 716 and the narrower extension 718 are pulled with considerable force, the pulling force would have to be greater than the tearing force required to tear through four material layers. This is rendered even more tear-resistant due to the presence of the arcuate notches 706. Materials that may provide enough tear resistance using just two or three layers may not require the flaps 710*a-b* to be L shaped. Rather, they may only be rectangular in shape (e.g., similar to flaps 708*a,b*) to serve the function of raising the floor of the first channel 214*a* to that of the center strip 210.

Figure 7C:
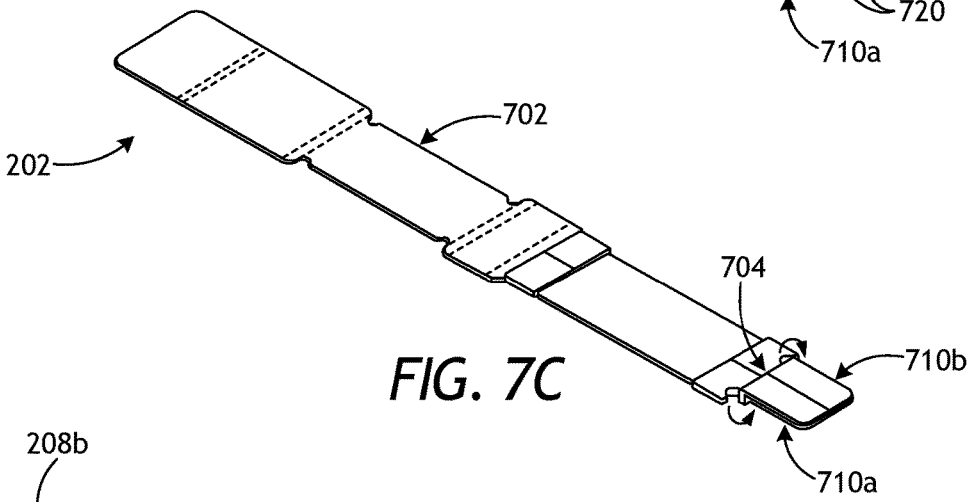
Figure 7D:
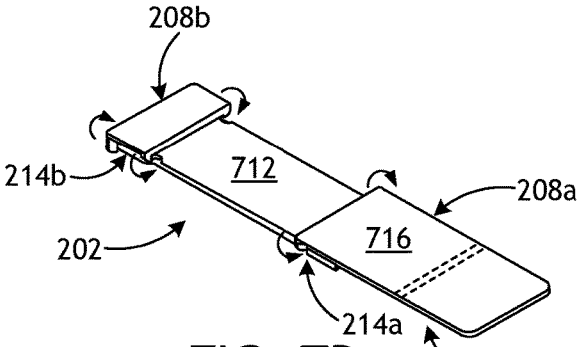

In FIG. 7C, the L-shaped flaps 710*a,b* have been folded upward at a corresponding score line 704 to form a raised portion of the base 202 that will ultimately form part of the first tab 208*a* (FIG. 7D).

In FIG. 7D, the panel 712 (FIG. 7A) and the scored extension 716 (FIG. 7A) have been folded along corresponding score lines 704 to form the second tab 208*b* constituting a raised (elevated) portion of the base 202. Moreover, the panel 712 is folded on top of the central support 714 (FIG. 7A) and the scored extension 716 is inverted onto the L-shaped flaps 710*a,b* (FIGS. 7A-7C) and covers them entirely to help form the first tab 208*a*. The distance D (FIG. 7A) between the corresponding score lines 704 are such that the first and second channels 214*a,b* are formed at the first and second tabs 208*a,b*.

Figure 7E:
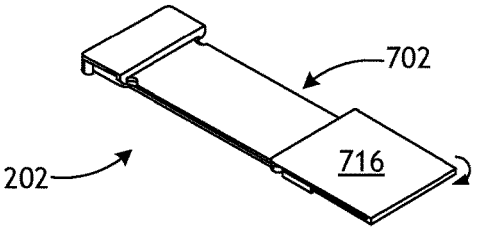

In FIG. 7E, the end portion of the scored extension 716 has been folded underneath itself to complete the assembly. Glue or an adhesive may be applied at various contact points during the assembly to secure the base 202 in its final configuration. In other embodiments, or in addition thereto, ultrasonic welding may be employed to secure the base 202 in its final configuration.

FIGS. 8A-8F depict step-by-step assembly of the sheath 204 in conjunction with the base 202 of FIGS. 6A-6B and 7A-7E, according to one or more embodiments. In the illustrated embodiment, the sheath 204 will be secured to four straps 106*a-d* (i.e., two pairs of straps). It will be appreciated, however, that some of the assembly steps of the following description may alternatively apply to an application including two straps.

Figure 8A:
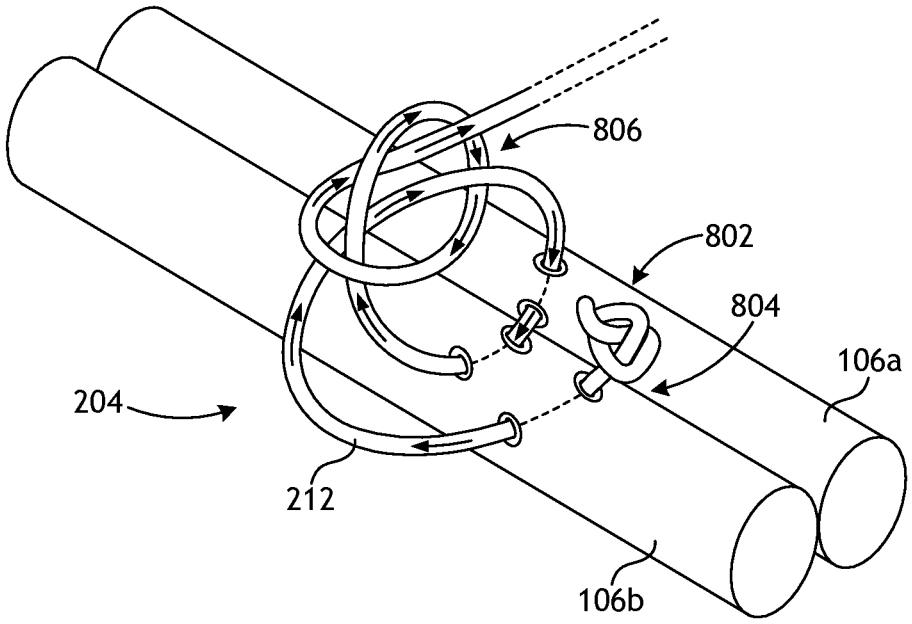
FIGS. 8A-8F depict step-by-step assembly of the sheath in conjunction with the base of FIGS. 6A-6B and 7A-7E, according to one or more embodiments.

In FIG. 8A, construction of the sheath 204 may be started by first tying a starting knot 802 to be positioned on the bottom (underside) of the straps 106*a,b*. The starting knot 802 may be tightened and arranged between the straps 106*a,b*, such as in the valley 804 formed therebetween. Positioning the starting knot 802 in the valley 804 allows the knot 802 to be hidden within the valley 804 so it does not obstruct operation of the fastening system 112. The cord 212 may then be threaded through portions of the bottom of each strap 106*a,b* and a secondary starting knot 806 may be formed, as indicated. In some embodiments, an adhesive may be applied to one or both of the knots 802, 806 once tightened. In at least one embodiment, the knots 802, 806 may help secure the first and second straps 106*a,b* to each other. For example, the knots 802, 806 may be representative of the fastening point 302*c* of FIG. 3.

Figure 8B:
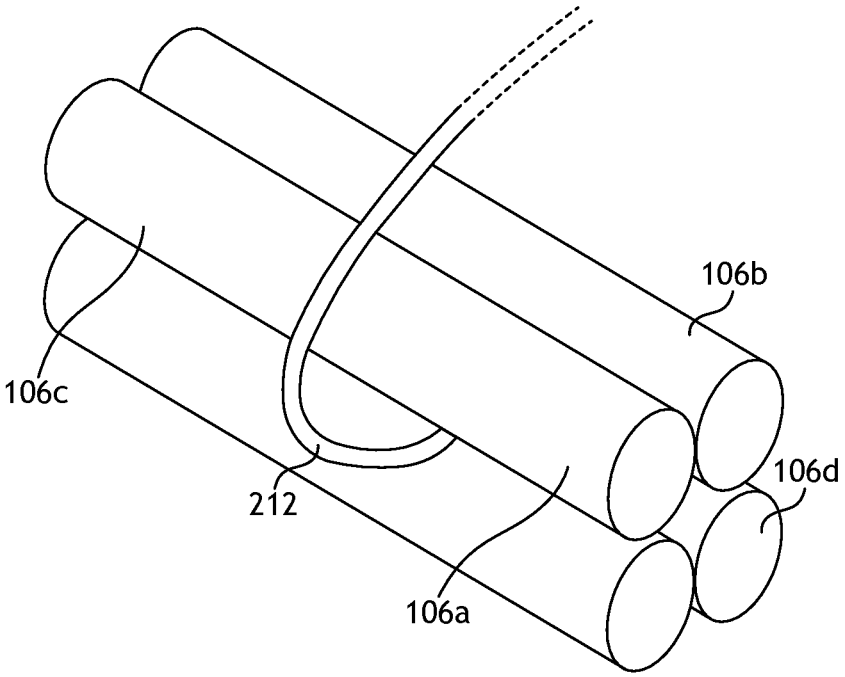

In FIG. 8B, the first and second straps 106*a,b* are flipped over and mated with the third and fourth straps 106*c,d*. The cord 212 may exit the straps 106*a-d* in the middle between the two pairs. The starting knot 802 (FIG. 8A) is completely hidden between the straps 106*a-d*.

Figure 8C:
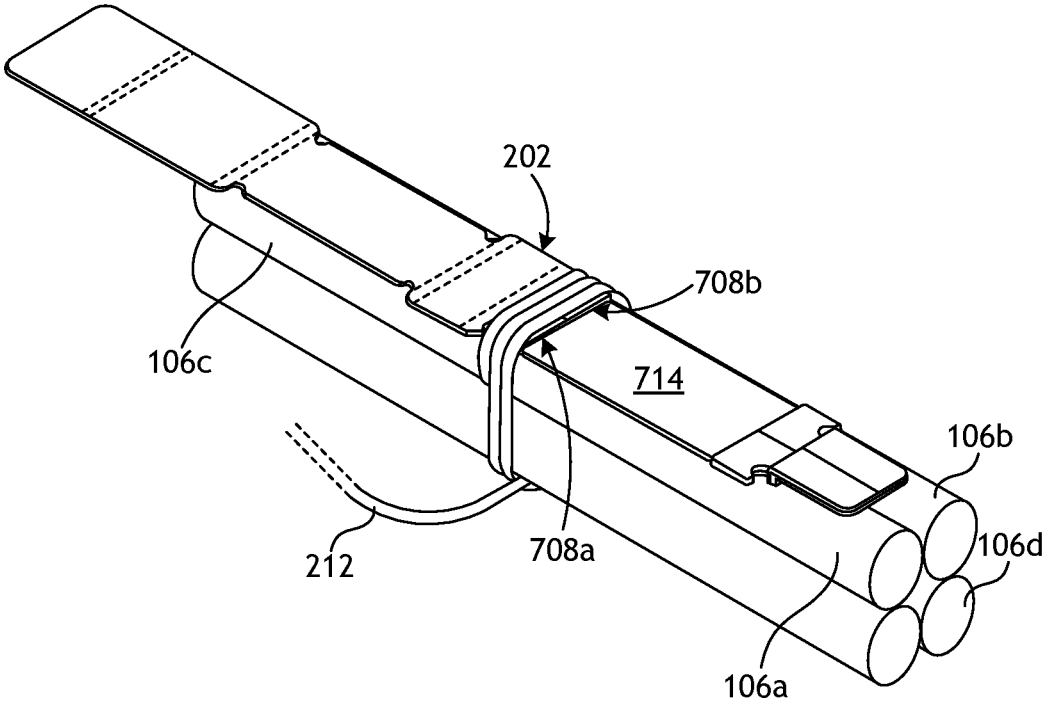

In FIG. 8C, a partially folded (assembled) base 202 may be longitudinally aligned with the straps 106*a-d* and otherwise laid lengthwise atop the first and second straps 106*a,b*. The cord 212 may then be wound about the base 202 and the straps 106*a-d*, starting at the location where the rectangular flaps 708*a,b* are folded inward and onto the top surface of the central support 714, which will form part of the second channel 214*b* (FIGS. 2, 6A-6B, and 7D). The cord 212 may be wrapped one or more times about the base 202 and the straps 106*a-d* and otherwise until the cord 212 fully covers the rectangular flaps 708*a,b*. An adhesive (or ultrasonic welding or other means) may be applied to the loops covering the rectangular flaps 708*a,b*, following which the base 202 may be folded onto itself to form the second channel 214*b* and cover the loops on the rectangular flaps 708*a,b*. The adhesive may permanently attach the cord 212 to the base 202 and help create a rigid wall that prevents the inner loops of the cord 212 from creeping (climbing) over adjacent loops outside of the second channel 214*b*. In other embodiments, however, an adhesive (or ultrasonic welding or other means) may not be required to attach the cord 212 to the base 202 and otherwise prevent inner loops of the cord 212 from climbing over adjacent loops. In such embodiments, for example the second channel 214*b* (and the first channel 214*a*) may be designed such that the inner loops of the cord 212 are physically (mechanically) prevented from climbing over adjacent loops. Accordingly, discussion of the use of an adhesive (or ultrasonic welding or other means) should not be considered limiting to the present disclosure.

Figure 8D:
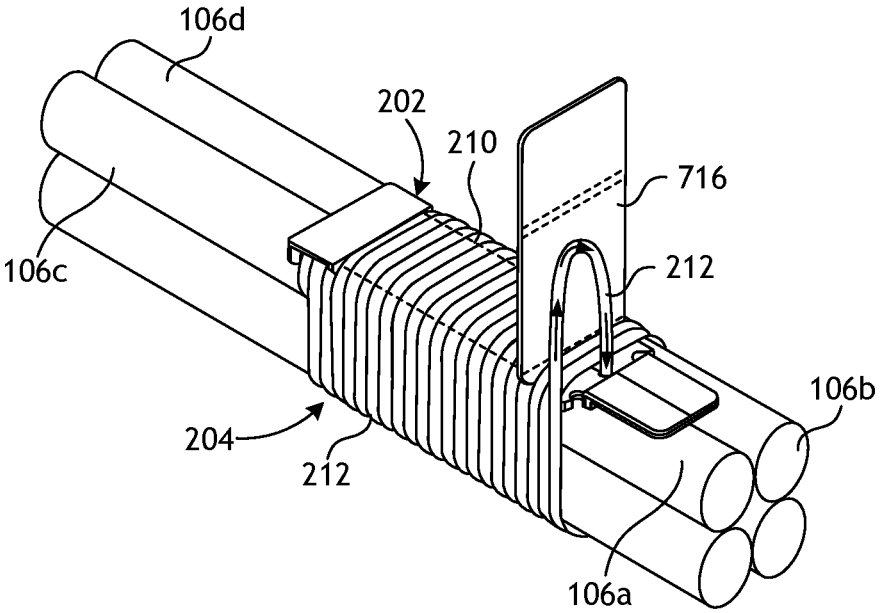

In FIG. 8D, the base 202 is folded on top of itself, as generally described above with reference to FIG. 7D. The cord 212 may then be progressively wrapped about the base 202 and the straps 106*a-d* along the length of the center strip 210 to form the sheath 204. The cord 212 may be progressively wrapped about the center strip 210 until reaching the location where the first channel 214*a* (FIGS. 2, 6A-6B, and 7D) will be formed. At this point, the scored extension 716 of the base 202 may be lifted up and the cord 212 may continue to be wrapped about the raised portion of the base 202 that will form the bottom of the first channel 214*a*. The cord 212 may be wrapped until the raised portion is fully or mostly covered, at which point the cord 212 may be inserted vertically downward and completely through the base 202. The cord 212 may penetrate the base 202 and enter the straps 106*a-d* where a knot may be formed to secure the base 202, the sheath 204, and the straps 106*a-b* together, as discussed below. In at least one embodiment, an adhesive (or ultrasonic welding or other means) may be applied to the loops of the cord 212 at the raised portion and before the scored extension 716 is folded downward to form the first channel 214*a*.

Figure 8E:
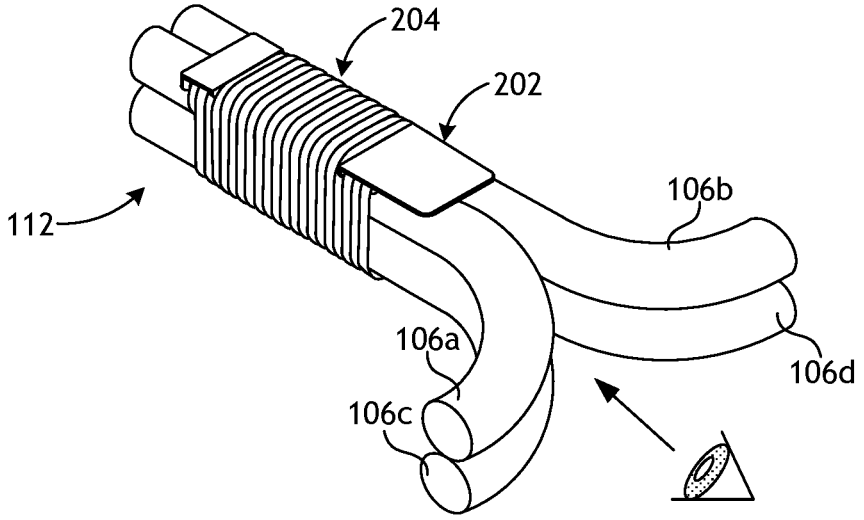
Figure 8F:
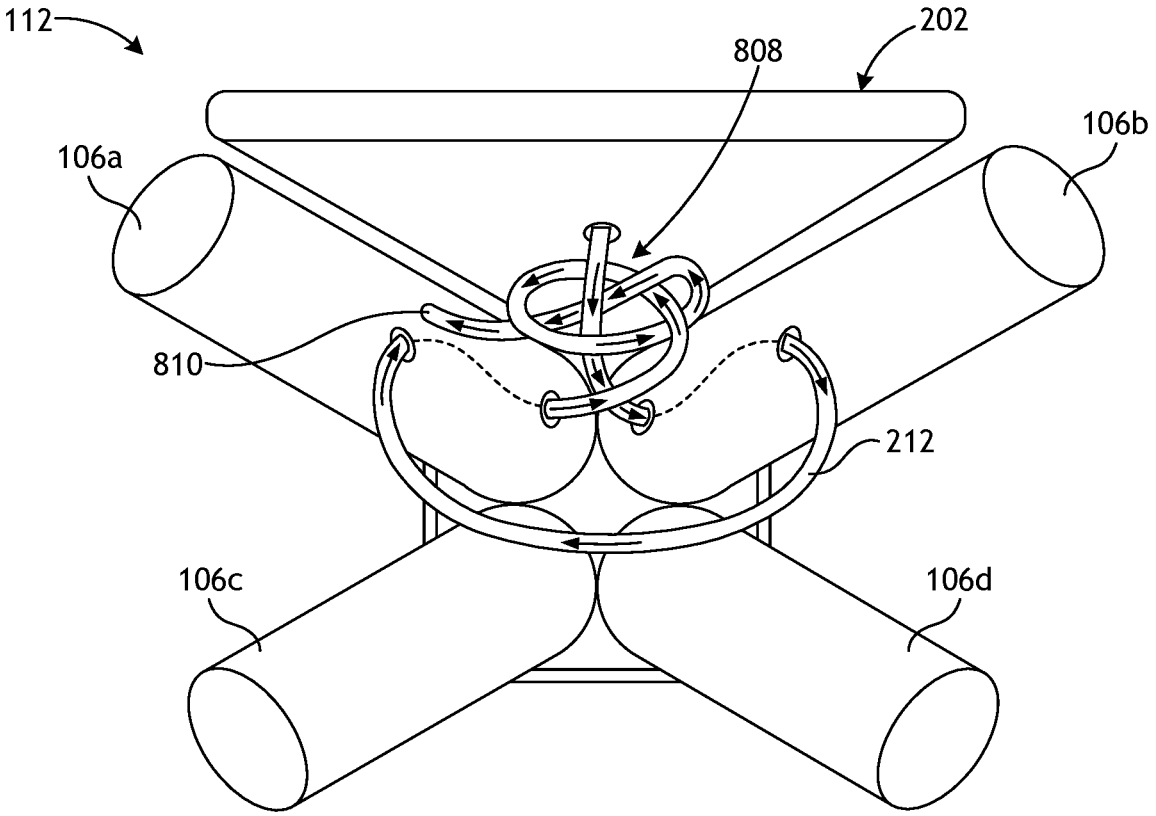

FIGS. 8E and 8F provide perspective and end views, respectively, of the assembly 112 upon finishing assembly of the sheath 204. More specifically, FIG. 8F depicts the view between (within) the straps 106*a-d* and below the base 202, as indicated by the eye in FIG. 8E. In FIG. 8F, the cord 212 extends from the bottom of the base 202 and is threaded through the first and second straps 106*a,b* at one or more locations. A closing knot 808 may then be formed with the cord 212, and once the closing knot 212 is tightened it may be positioned between the straps 106*a-d* to hide the closing knot 212. Tightening the closing knot 212 may be achieved by simply pulling on the end 810 of the cord 212 to take up the slack, which may cause the first and second straps 106*a,b* to be brought together and thereby lock the cord 212 in place and thereby secure the base 202, the sheath 204 (made via the cord 212), and the straps 106*a-b* together. An adhesive (or ultrasonic welding or other means) may be applied to the closing knot 808, if desired.

Figure 9:
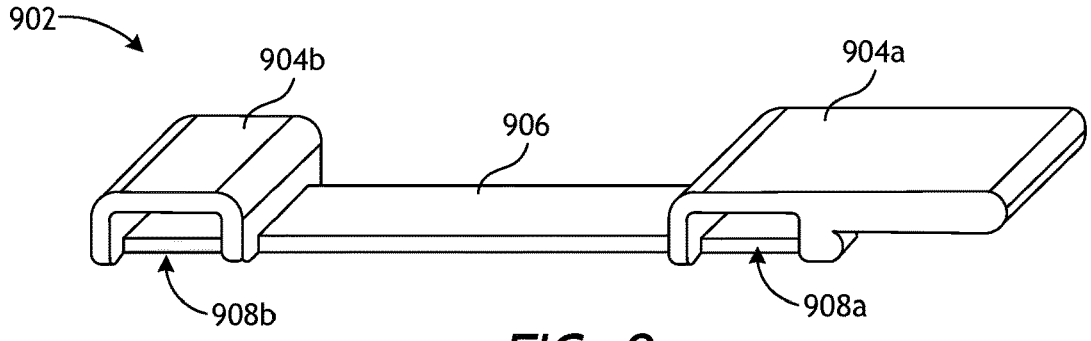
FIG. 9 is a perspective view of another example base, according to one or more additional embodiments.

FIG. 9 is a perspective view of another example base 902, according to one or more additional embodiments. The base 902 may be similar in some respects to the base 202 of FIGS. 2, 4, 6A-6B, and 7A-7E and therefore may be best understood with reference thereto. Similar to the base 202, the base 902 may be used in the fastening system 112 of FIGS. 1-4. Moreover, similar to the base 202, the base 902 may be used with the sheath 204, and the combination of the base 902 and the sheath 204 may be characterized or otherwise referred to as a "sleeve."

Unlike the base 202, however, the base 902 may comprise an injection molded or 3D printed part made of a variety of materials. In some embodiments, the base 902 may be injection molded in a single shot. In other embodiments, however, the base 902 may be co-molded in two or more shots, without departing from the scope of the disclosure. Suitable materials for the base 902 include, but are not limited to, a polymer (e.g., polyester, polypropylene, nylon, thermoplastic polyurethane, acrylonitrile butadiene styrene, thermoplastic rubber, polylactic acid, polyvinyl acetate, polyethylene terephthalate, polyethylene terephthalate copolyester, high impact polystyrene, etc.), a metal (e.g., copper, bronze, aluminum, stainless steel, an alloy, etc.), and any combination thereof.

As illustrated, the base 902 may provide or otherwise define a first tab 904*a*, a second tab 904*b*, and a center strip 906 extending between the first and second tabs 904*a,b*. The tabs 904*a,b* may define corresponding channels 908*a* and 908*b*, respectively, configured to receive one or more loops of the cord 212 (FIGS. 2, 4, and 6B) to help form the sheath 204. As illustrated, the first and second tabs 904*a,b* may be wider (larger) than the center strip 906, which helps prevent the cord 212 from shifting on top of the tabs 904*a,b* and otherwise climbing over the loops of the cord 212 passing through the channels 908*a,b*. Moreover, the tabs 904*a,b* may form a raised (elevated) transition from the center strip 906, which may also help prevent the cord 212 traversing the center strip 906 from shifting on top of the tabs 904*a,b*. In some embodiments, the knots 802, 806, and 808 of FIGS. 8A-8F may also be made with the cord 212 to help secure the sheath 204 to the base 902 and the straps 106*a-d* (FIGS. 8A-8F).

Figure 10A:
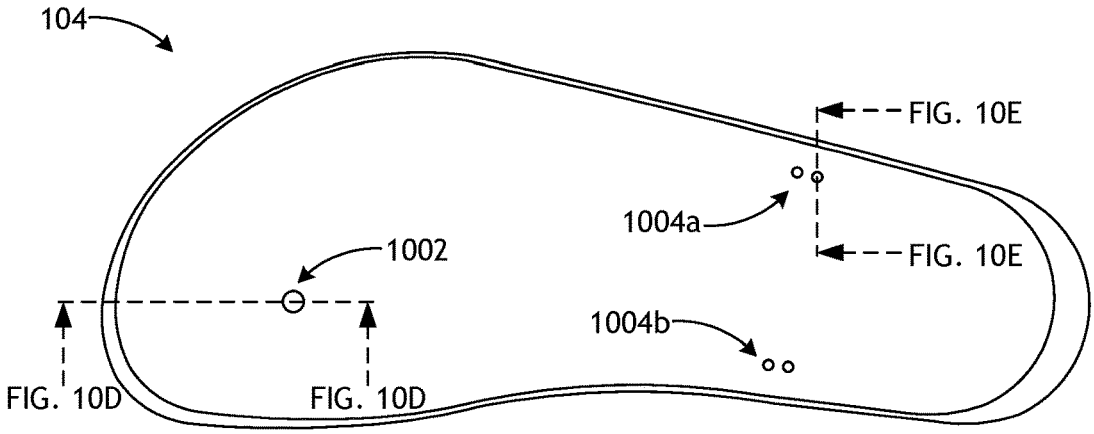
FIGS. 10A-10E are various views of the sole of FIG. 1.

FIGS. 10A-10E are various views of the sole 104 of FIG. 1, according to one or more embodiments of the disclosure. FIG. 10A is a top view of the sole 104. As illustrated, the sole 104 may include a front strap aperture 1002, a first pair of side strap apertures 1004*a*, and a second pair of side strap apertures 1004*b*. The front strap aperture 1002 and the first and second pairs of side strap apertures 1004*a,b* may each be sized to receive and secure the straps (e.g., straps 106*a-d* of FIGS. 2-3) used to secure the sole 104 to a user's foot. In at least one embodiment, one or both of the first and second pairs of side strap apertures 1004*a,b* may alternatively comprise a single aperture that accepts a pair of straps or a single strap instead of a pair of straps.

Figure 10B:
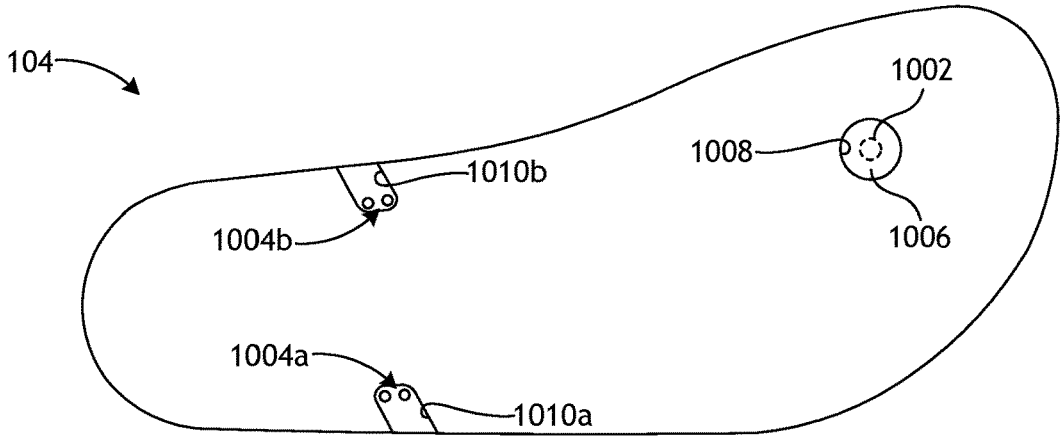

FIG. 10B is a bottom view of the sole 104. The bottom of the sole 104 may provide a toe plug 1006 sized to be received within a plug aperture 1008. The plug aperture 1008 may extend from the front strap aperture 1002 (shown in dashed lines), and the toe plug 1006 may be received within a plug aperture 1008 to occlude the front strap aperture 1002 and one or more straps received within the front strap aperture 1002. In some embodiments, the toe plug 1006 may be inset (recessed) within the plug aperture 1008 such that the toe plug 1006 does not contact the underlying surface (e.g., the ground or floor).

The bottom of the sole 104 may also define a first groove 1010*a* and a second groove 1010*b*. The first and second grooves 1010*a,b* may be aligned with the first and second pairs of side strap apertures 1004*a,b*, respectively. Corresponding straps (not shown) may extend through the first and second side strap apertures 1004*a,b* to be received within the first and second grooves 1010*a,b*. The first and second grooves 1010*a,b* are defined into the bottom of the sole 104 and provide an area where the straps can be rerouted toward the top of the sole 104. Moreover, the grooves 1010*a,b* may be deep enough that the rerouted straps do not contact the underlying surface (e.g., the ground or floor).

Figure 10C:
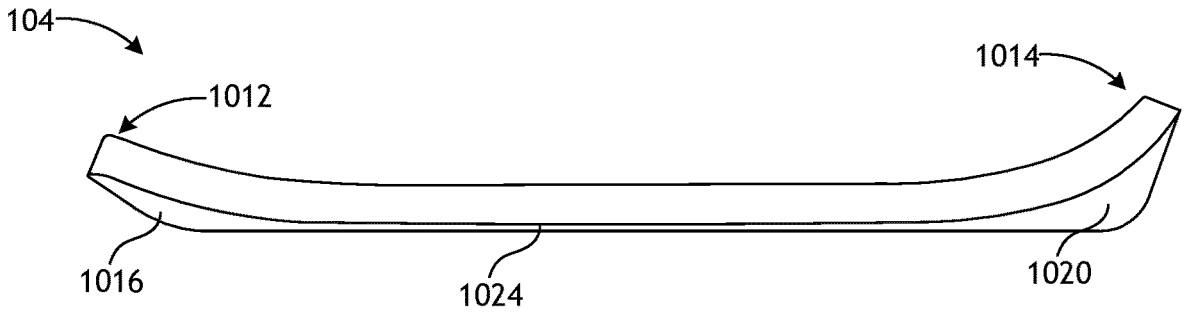

FIG. 10C is a side view of the sole 104. As illustrated, the sole 104 provides a front 1012 and a back 1014. In some embodiments, the front 1012 of the sole 104 may provide or otherwise define a toe guard 1016 that may be angled upward relative to the main body of the sole 104. The angled nature of the toe guard 1016 may be designed to reduce the occurrence of the front 1012 catching on the ground or floor, and help the user scale stairs without catching the front 1012 on the stairs. As illustrated, the toe guard 106 may define a convex curve or curvature similar in shape to the profile of the hallux toe 108 (FIG. 1). In some embodiments, the convex curve of the toe guard may extend about a quarter of a circle in cross section, or a smaller portion of the circle.

Angling the toe guard 1016 upward may also prove advantageous in allowing the sole 104 to be shorter as compared to a conventional sandal sole for the same length foot. More particularly, when the sole of sandals are flat, toe allowance (of 4-12 mm, depending on shoe style and foot size) needs to be added in front of the toes to account for (1) the foot moving longitudinally along the sole while taking a step, and (2) bending of the sole during use. The sole typically needs to curve around the foot a small distance, thus requiring a length that is longer than that of the foot. The toe guard 1016 may prove advantageous since the 'horizontal distance' required by the toe allowance is considerably reduced or eliminated because the curvature of the toe guard 1016 provides the same required toe allowance using a shorter horizontal distance.

In some embodiments, the back 1014 of the sole 104 may provide or otherwise define a heel guard 1020 that may be angled upward relative to the main body of the sole 104. The heel guard 1020 may be designed to keep the heel of the user's foot off the ground or floor. As illustrated, the heel guard 1020 may define a convex curve or curvature similar in shape to the profile of the heel. The heel guard 1020 may prove especially advantageous to a user when driving, since the heel guard 1020 may prevent the user's heel from touching the floor mat.

In some embodiments, one or both of the sides 1024 of the sole 104 may curve upwards. The upward curvature of the sides 1024 may help improve longitudinal structure of the sole 104. For example, the upward curvature of the sides 1024 may help mitigate or prevent "flapping" or other contact noises when the sole 104 strikes the ground or floor.

Figure 10D:
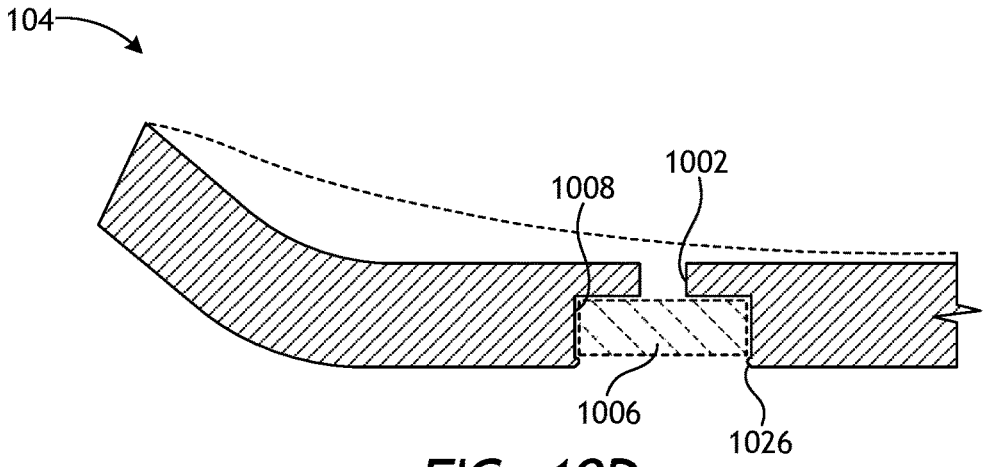

FIG. 10D is a cross-sectional side view of the sole 104 as taken along the lines indicated in FIG. 10A. More specifically, FIG. 10D depicts the front strap aperture 1002 extending from the top of the sole 104 and the plug aperture 1008 extending from the bottom of the sole 104. In at least one embodiment, the plug aperture 1008 may provide or otherwise define an annular lip 1026 configured to receive and secure the toe plug 1006 (shown in dashed lines) within the plug aperture 1008. Moreover, the annular lip 1026 may be configured to seat the toe plug 1006 within the plug aperture 1008 in a recessed location such that the toe plug 1006 is offset from the bottom of the sole 104. This may prove advantageous in preventing the toe plug 1006 from contacting the underlying surface (e.g., the ground or floor), thus preventing any clacking sound or a reduction in traction caused by the toe plug 1006 contacting the floor.

Figure 10E:
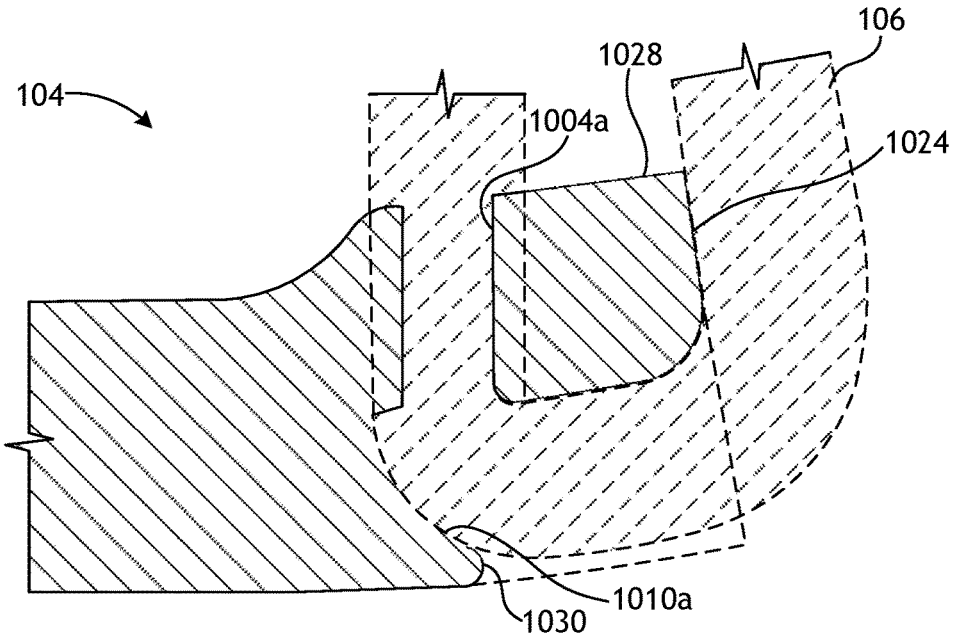

FIG. 10E is a cross-sectional side view of the sole 104 as taken along the lines indicated in FIG. 10A. More specifically, FIG. 10E depicts one of the first side strap apertures 1004*a* extending from the top of the sole 104 and the first groove 1010*a* defined into the bottom of the sole 104. FIG. 10E also depicts a strap 106 extending through the side strap aperture 1004*a* and being rerouted toward the top of the sole 104 via the first groove 1010*a*. As illustrated, the diameter of the side strap aperture 1004*a* may be less than the diameter of the strap 106. This may prove advantageous in facilitating a frictional engagement between the strap 106 and the strap aperture 1004*a* to help maintain the strap adjustment made by the user.

In some embodiments, the sole 104 may provide an enlarged portion 1028 laterally adjacent the strap aperture 1004*a* at the outer edge or side 1024 of the sole 104. The enlarged portion 1028 may be thicker above the first groove 1010*a* to reinforce the sole 104 against increased pulling forces in this area. Depending on the material used for the sole 104, increasing the volume of material at the enlarged portion 1028 may prove advantageous in increasing tear resistance in that area.

In some embodiments, a raised profile 1030 may be provided or otherwise defined within the first groove 1010*a*. The strap aperture 1004*a* may help redirect the strap 106 through the sole 104, and the first groove 1010*a* provides a slot for the strap 106 to sit in. The first groove 1010*a* and the raised profile 1030 may cooperatively operate to help keep the strap 106 offset from the underlying ground or floor. This may prove advantageous in preventing the strap 106 from being damaged (frayed) from repeated contact with the ground, thus prolonging the life of the strap 106.

Figure 11:
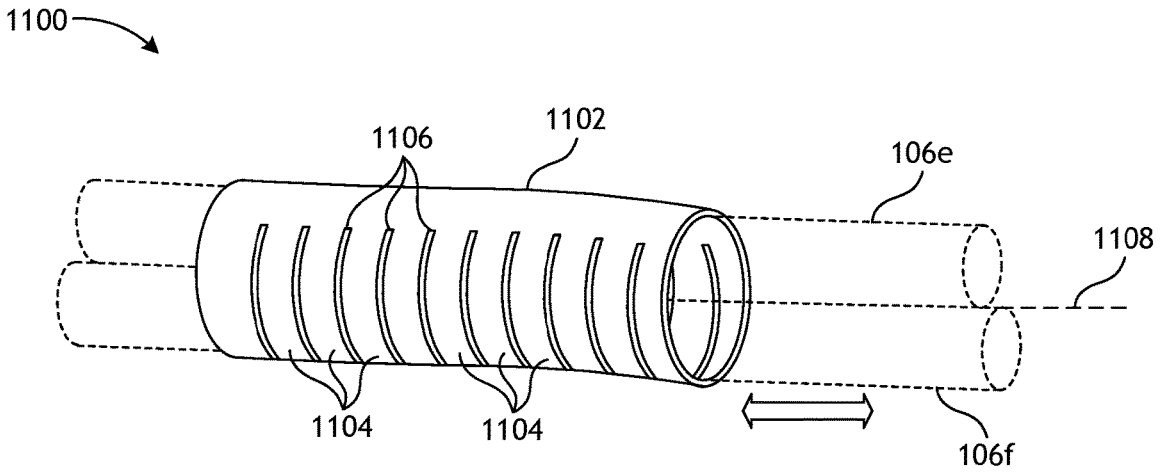
FIG. 11 is an enlarged isometric view of another example fastening system, according to one or more additional embodiments.

FIG. 11 is an enlarged isometric view of another example fastening system 1100, according to one or more embodiments. The fastening system 1100 may be similar in some respects to the fastening system 112 depicted in FIGS. 4 and 5A-5B and therefore may be best understood with reference thereto, where like numerals will correspond to similar components. Moreover, in at least one embodiment, the fastening system 1100 may replace the fastening system 112 shown in FIG. 1. Similar to the fastening system 112 of FIGS. 4 and 5A-5B, for example, the fastening system 1100 may be secured to and otherwise positioned about the fifth and sixth straps 106*e,f* (shown in dashed lines). Unlike the fastening system 112, however, which includes the base 202 and the sheath 204 that cooperatively form a "sleeve," the fastening system 1100 includes a sleeve 1102 that comprises a unitary structure that encircles the straps 106*e,f*.

As illustrated, the sleeve 1102 may comprise a generally tube-like or cylindrical body and the straps 106*e,f* may be configured to extend longitudinally therethrough. The body of the sleeve 1102 may be made of a flexible material including, but not limited to, a natural material (e.g., rubber, latex, leather, etc.) a polymer (e.g., thermoplastic polyurethane, polyester, polypropylene, nylon, acrylonitrile butadiene styrene, thermoplastic rubber, thermoplastic elastomer, polylactic acid, polyvinyl acetate, polyvinyl chloride. polyethylene terephthalate, polyethylene terephthalate copolyester, high impact polystyrene, silicone, etc.), a woven or braided material, a non-woven material (e.g., non-woven wool, a microfiber fabric, etc.), or any combination thereof.

The sleeve 1102 may provide or otherwise define a plurality of braking members 1104. In the illustrated embodiment, the braking members 1104 may be formed by making one or more slits or cuts 1106 in the material of the sleeve 1102. In some embodiments, the cuts 1106 may be formed during the manufacturing process of the sleeve 1102, such as through an injection molding process or a 3D printing process. In other embodiments, however, the cuts 1106 may be formed in the sleeve 1102 after the sleeve 1102 has been manufactured, such as through laser cutting or cutting the sleeve 1102 with a cutting die or knife.

The cuts 1106 may be formed through only a portion of the circumference of the sleeve 1102 and not the entire circumference. In some embodiments, for example, the cuts 1106 may extend from about 25° to about 335° about the circumference of the sleeve 1102, and any angular magnitude therebetween. In some embodiments, one or more of the cuts 1106 may extend to different angular magnitudes, thus forming braking members 1104 having dissimilar dimensions. The cuts 1106 may be thin or may alternatively form a visible gap between adjacent braking members 1104.

In the illustrated embodiment, the sleeve 1102 may be secured (fixed) to the fifth strap 106*e* and pulling the sixth strap 106*f* in either direction while the sleeve 1102 is braced (e.g., with one's fingers) may adjust the tension in the straps 106*e,f* against the foot 102 (FIG. 1). More specifically, the fifth strap 106*e* may be secured (fixed) to the underside of the sleeve 1102 such that the sleeve 1102 and the fifth strap 106*e* may be movable relative to the sixth strap 106*f* (or vice versa) to adjust strap tension. The fifth strap 106*e* may be secured (fixed) to the base 202 and the sheath 204 using an adhesive, ultrasonic welding, a combination thereof, or the like.

In example operation, when no tension is applied on the sixth strap 106*f*, the braking members 1104 may reside substantially perpendicular to a longitudinal axis 1108 of the sleeve 1102. When tension is applied on the sixth strap 106*f*, however, the braking members 1104 will move from perpendicular in the direction of the tensile load. Such movement places the braking members 1104 at an angle relative to the longitudinal axis 1108, which increases the tension in the braking members 1104 and thereby enhances the friction between the braking members 1104 and the sixth strap 106*f*. Accordingly, the braking members 1104 may resist movement of the sixth strap 106*f* in the direction of the tensile load.

Figure 12:
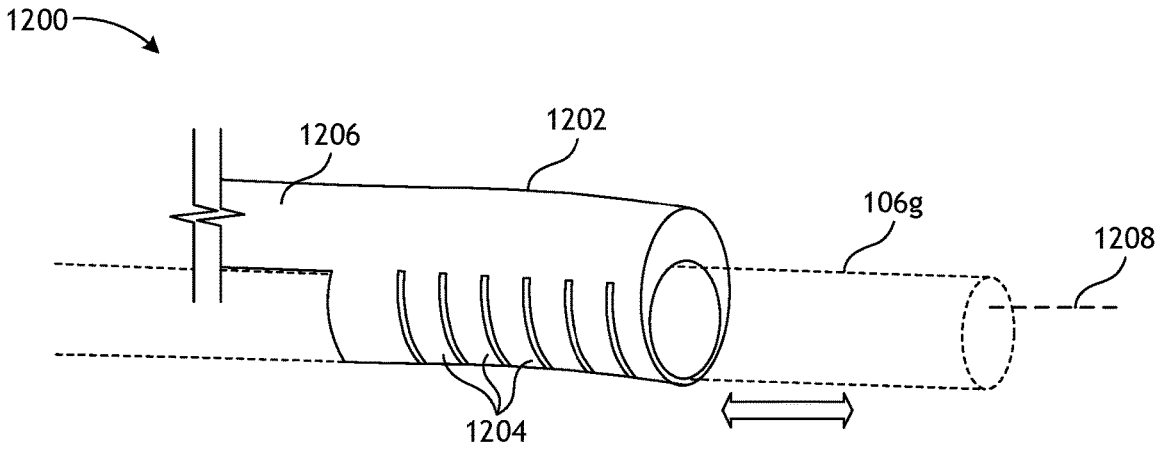
FIG. 12 is an enlarged isometric view of another example fastening system, according to one or more additional embodiments.

FIG. 12 is an enlarged isometric view of another example fastening system 1200, according to one or more embodiments. The fastening system 1200 may be similar in some respects to the fastening system 1100 of FIG. 11 and therefore may be best understood with reference thereto, where like numerals will correspond to similar components. Moreover, in at least one embodiment, the fastening system 1200 may replace the fastening system 112 shown in FIG. 1. Similar to the fastening system 1100 of FIG. 11, for example, the fastening system 1200 may include a sleeve 1202 configured to encircle one or more straps. Unlike the fastening system 1100, however, the sleeve 1202 may be configured to encircle or otherwise work with a single strap, shown in FIG. 12 as a seventh strap 106*g* (shown in dashed lines). The seventh strap 106*g* may be the same as or similar to any of the straps 106*a-f* discussed herein.

The sleeve 1202 may comprise a generally tube-like or cylindrical body, and the strap 106*g* may be configured to extend longitudinally therethrough. The body of the sleeve 1202 may be made of any of the flexible materials mentioned above with reference to the sleeve 1102 of FIG. 11, and a plurality of braking members 1204 may be defined in the sleeve 1202 similar to the braking members 1104 of FIG. 11.

Unlike the fastening system 1100, the sleeve 1202 may further include an extension 1206 that extends axially away from the main body of the sleeve 1202. In embodiments where the fastening system 1200 is applied to a sandal, the extension 1206 may be coupled to a part of the sandal. In at least one embodiment, for example, the extension 1206 may be coupled to the sole (e.g., the sole 104 of FIGS. 1 and 10A-10D). In other embodiments, however, the extension 1206 may be secured to (e.g., looped around) another portion of the strap 106*g*. In any scenario, the extension 1206 may be configured to secure the sleeve 1202 in place relative to the strap 106*g*.

The seventh strap 106*g* may be able to move relative to the sleeve 1202 (while bracing the sleeve 1202) to adjust the tension in the strap 106*g* against the foot 102 (FIG. 1). In example operation, when no tension is applied on the strap 106*g*, the braking members 1204 may reside substantially perpendicular to a longitudinal axis 1208 of the sleeve 1202. When tension is applied on the strap 106*g*, however, the braking members 1204 will move from perpendicular in the direction of the tensile load. Such movement places the braking members 1204 at an angle relative to the longitudinal axis 1208, which increases the tension in the braking members 1204 and thereby enhances the friction between the braking members 1204 and the strap 106*g*. Accordingly, the braking members 1204 may resist movement of the strap 106*g* in the direction of the tensile load.

Figure 13:
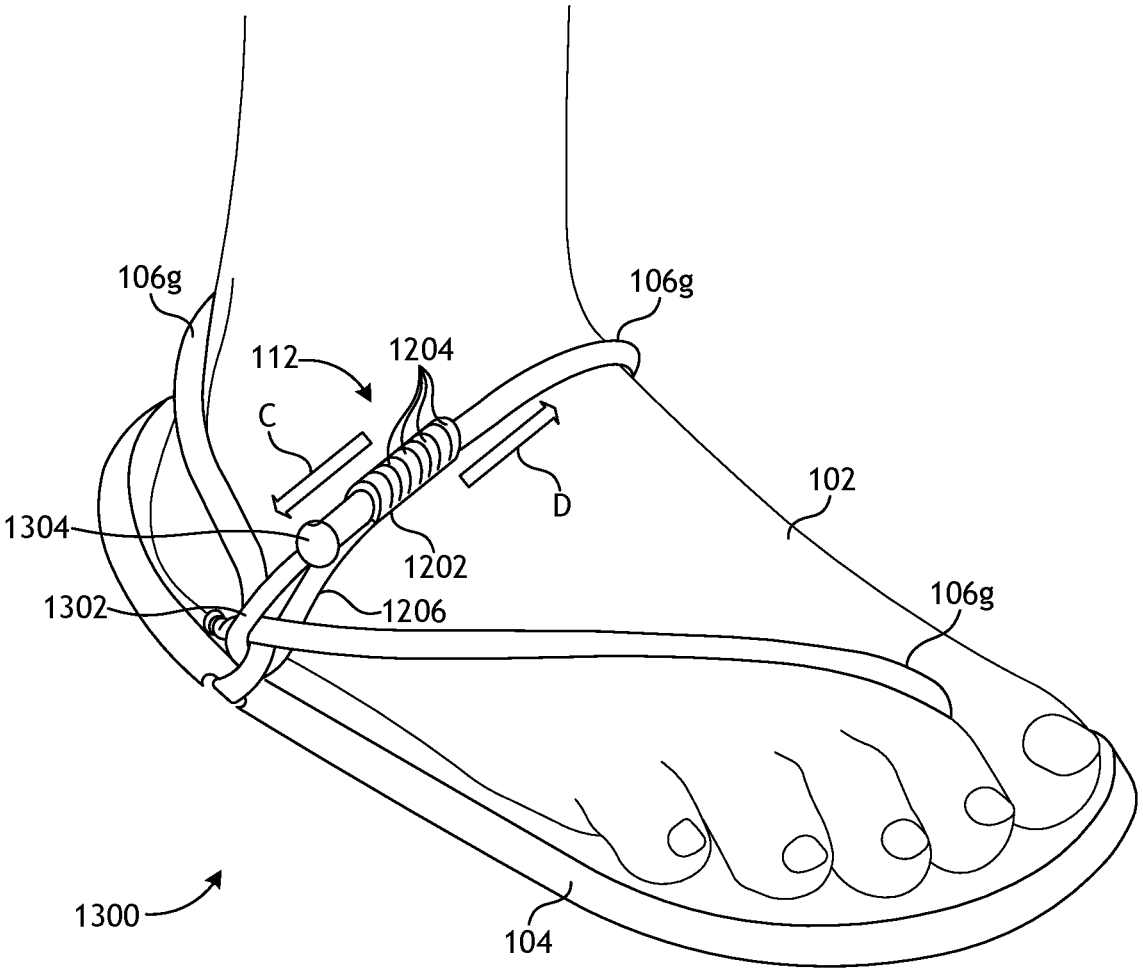
FIG. 13 is an isometric view of another example sandal that incorporates the fastening system of FIG. 12, according to one or more embodiments of the present disclosure.

FIG. 13 is an isometric view of an example sandal 1300 that incorporates the fastening system 1200 of FIG. 12, according to one or more embodiments of the present disclosure. The sandal 1300 may be similar in some respects to the sandal 100 of FIG. 1 and therefore may be best understood with reference thereto, where like numerals will represent like components not described again. As illustrated, the sandal 1300 includes the sole 104, and the seventh strap 106*g* is configured to attach the sole 104 to the foot 102. The strap 106*g* may loop or otherwise extend around one or more of the forefoot, the ankle, and the heel of the foot 102 to secure the sandal 1300 to the foot 102.

The fastening system 1200 may be operatively coupled to the sandal 1300, as generally described above. In the illustrated embodiment, for example, the extension 1206 extends from the sleeve 1202 and forms an eyelet 1302. A portion of the strap 106*g* may extend through the eyelet 1302 to secure the fastening system 1200 to the sandal 1300. In other embodiments, however, the extension 1206 may be directly attached to the sole 104.

The fastening system 1200 is operatively coupled to the strap 106*g*, and pulling the strap 106*g* in either direction relative to the fastening system 112 while the sleeve 1202 is braced (e.g., with one's fingers) will adjust the tension in the strap 106*g* against the foot 102. In some embodiments, an end of the strap 106*g* may have a stop member 1304 coupled thereto or otherwise forming an integral part thereof. The stop member 1304 may comprise a structure or feature having a diameter or size larger than the inner diameter of the sleeve 1202. Consequently, the stop member 1304 may help prevent the strap 106*g* from being released from the sleeve 1202.

In operation, the strap 106*g* may be movable (slidable) in a first direction C relative to the sleeve 1202 (and while bracing the sleeve 1202) to tighten the strap 106*g* against the foot 102, and movable (slidable) in a second direction D opposite the first direction C to loosen the strap 106*g*. When tension is applied on the strap 106*g* in the second direction D, however, friction between the braking members 1204 and the strap 106*g* may increase and thereby resist movement of the strap 106*g* in the second direction D.

Embodiments disclosed herein include:

A. A fastening system that includes a sleeve having a cylindrical body, and one or more braking members provided on the sleeve, wherein at least one strap is extendable through the sleeve and movable relative to the sleeve while the sleeve is braced, and wherein the one or more braking members resist movement of the at least one strap relative to the sleeve.

B. A sandal to be worn on a foot, the sandal comprising a sole, at least one strap coupled to the sole and extendable around one or more of a forefoot, an ankle, and a heel of the foot, and a fastening system operatively coupled to the at least one strap. The fastening system including a sleeve having a cylindrical body, and one or more braking members provided on the sleeve, wherein the at least one strap extends through the sleeve and is movable relative to the sleeve while the sleeve is braced to adjust a tension in the at least one strap against the foot, and wherein the one or more braking members resist movement of the at least one strap relative to the sleeve.

Each of embodiments A and B may have one or more of the following additional elements in any combination: Element 1: wherein the at least one strap comprises at least two straps, and wherein the sleeve comprises a base having a first end and a second end opposite the first end, and a sheath extending about the base and providing the one or more braking members, wherein the at least two straps are extendable through the sheath and one of the at least two straps is fixed to the base. Element 2: further comprising a first tab provided at the first end and defining a first channel, a second tab provided at the second end and defining a second channel, and a center strip extending between the first and second tabs, wherein the sheath comprises a cord wrapped multiple times around the center strip and extending through the first and second channels, and wherein one or more loops of the cord comprises the one or more braking members. Element 3: wherein the at least two straps comprise one or more first straps fixed to the base, and one or more second straps movable relative to the one or more first straps, the base, and the sheath. Element 4: wherein the one or more first straps comprise a first pair of straps arranged side-by-side, and the one or more second straps comprise a second pair of straps arranged side-by-side. Element 5: wherein the base comprises a strip of base material providing one or more of i) a plurality of score lines where the base material is folded to form the base and ii) one or more arcuate notches defined in the base material. Element 6: wherein the base is injection molded or 3D printed. Element 7: wherein the one or more braking members are formed in the sleeve with one or more cuts. Element 8: wherein the at least one strap comprises a first strap secured to the sleeve, and a second strap movable relative to the first strap and the sleeve to adjust a tension in the fastening system. Element 9: wherein the at least one strap comprises a single strap and the sleeve includes an extension that extends axially away from the sleeve and secures the sleeve relative to the single strap. Element 10: wherein the sleeve is injection molded or 3D printed.

Element 11: wherein the at least one strap comprises at least two straps coupled to the sole, and wherein the sleeve comprises a base having a first end and a second end opposite the first end, and a sheath extending about the base and providing the one or more braking members, wherein the at least two straps are extendable through the sheath and at least one of the at least two straps is fixed to the base. Element 12: further comprising a first tab provided at the first end and defining a first channel, a second tab provided at the second end and defining a second channel, and a center strip extending between the first and second tabs, wherein the sheath comprises a cord wrapped multiple times around the center strip and the at least two straps and the cord extends through the first and second channels. Element 13: wherein the at least two straps comprise one or more first straps fixed to the base, and one or more second straps movable relative to the one or more first straps, the base, and the sheath. Element 14: wherein the one or more braking members are formed in the sleeve with one or more cuts. Element 15: wherein the at least one strap comprises a first strap secured to the sleeve, and a second strap movable relative to the first strap and the sleeve to adjust the tension in the at least one strap against the foot. Element 16: wherein the at least one strap comprises a single strap and the sleeve includes an extension that couples the sleeve to the sandal. Element 17: wherein the sole has a front and a back and provides a toe guard at the front that is angled upward relative to horizontal. Element 18: wherein the sole has a front and a back and provides a heel guard at the back that is angled upward relative to horizontal. Element 19: wherein the sole comprises a strap aperture defined in a top surface of the sole sized to receive the at least one strap, and a groove defined in a bottom surface of the sole to receive the at least one strap from the strap aperture, wherein the groove defines a slot that redirects the at least one strap back toward the top surface of the sole, and wherein the slot has a depth sufficient to prevent the at least one strap from contacting the underlying surface. Element 20: wherein the at least one strap is adjustable relative to the sleeve to adjust the tension in the at least one strap against each of the forefoot, the ankle, and the heel of the foot.

By way of non-limiting example, exemplary combinations applicable to A and B include: Element 1 with Element 2; Element 2 with Element 3; Element 3 with Element 4; Element 1 with Element 5; Element 1 with Element 6; Element 7 with Element 8; Element 8 with Element 9; Element 11 with Element 12; Element 11 with Element 13; Element 14 with Element 15; and Element 14 with Element 16.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A fastening system, comprising:

at least first and second straps;

a cylindrical sleeve defining a channel for receiving the first and second straps, the cylindrical sleeve comprising:

a base having a first end and a second end opposite the first end; and a sheath extending about the base, wherein the first and second straps extend through the sheath and the first strap is fixed to the base; and a plurality of braking members forming part of the cylindrical sleeve and extending at least partially about the first and second straps, wherein the second strap extends and slides through the channel while the cylindrical sleeve is manually braced, and wherein the plurality of braking members resist movement of the second strap relative to the cylindrical sleeve when the cylindrical sleeve is not manually braced.

2. The fastening system of claim 1, further comprising:

a first tab provided at the first end and defining a first channel;

a second tab provided at the second end and defining a second channel; and a center strip extending between the first and second tabs, wherein the sheath comprises a cord wrapped multiple times around the center strip and extending through the first and second channels, and wherein one or more loops of the cord comprises the plurality of braking members.

3. The fastening system of claim 2, wherein the first strap comprises one or more first straps fixed to the base, and the second strap comprises one or more second straps movable relative to the one or more first straps, the base, and the sheath.

4. The fastening system of claim 3, wherein the one or more first straps comprise a first pair of straps arranged side-by-side, and the one or more second straps comprise a second pair of straps arranged side-by-side.

5. The fastening system of claim 1, wherein the base is injection molded or 3D printed.

6. The fastening system of claim 1, wherein the cylindrical sleeve is injection molded or 3D printed.

7. A sandal to be worn on a foot, comprising:

a sole;

at least first and second straps coupled to the sole and extendable around one or more of a forefoot, an ankle, and a heel of the foot;

a fastening system operatively coupled to the strap first and second straps and including:

a cylindrical sleeve defining a channel for receiving the first and second straps, the cylindrical sleeve comprising a base having a first end and a second end opposite the first end, and a sheath extending about the base, wherein the first and second straps extend through the sheath and the first strap is fixed to the base; and a plurality of braking members forming part of the cylindrical sleeve and extending at least partially about the first and second straps, wherein the second strap extends and slides through the channel while the cylindrical sleeve is manually braced to adjust a tension against the foot, and wherein the plurality of braking members resist movement of the second strap relative to the cylindrical sleeve when the cylindrical sleeve is not manually braced.

8. The sandal of claim 7, further comprising:

a first tab provided at the first end and defining a first channel;

a second tab provided at the second end and defining a second channel; and a center strip extending between the first and second tabs, wherein the sheath comprises a cord wrapped multiple times around the center strip and the first and second straps and the cord extends through the first and second channels.

9. The sandal of claim 7, wherein the first strap comprises one or more first straps fixed to the base, and the second strap comprises one or more second straps movable relative to the one or more first straps, the base, and the sheath.

10. The sandal of claim 7, wherein the sole has a front and a back and provides a toe guard at the front that is angled upward relative to horizontal.

11. The sandal of claim 7, wherein the sole has a front and a back and provides a heel guard at the back that is angled upward relative to horizontal.

12. The sandal of claim 7, wherein the sole comprises:

a strap aperture defined in a top surface of the sole sized to receive at least one of the first and second straps; and a groove defined in a bottom surface of the sole to receive the at least one of the first and second straps from the strap aperture, wherein the groove defines a slot that redirects the at least one of the first and second straps back toward the top surface of the sole, and wherein the slot has a depth sufficient to prevent the at least one of the first and second straps from contacting the underlying surface.

13. The sandal of claim 7, wherein the second strap is adjustable relative to the cylindrical sleeve to adjust the tension in the second strap against each of the forefoot, the ankle, and the heel of the foot.

* * * * *